US005531208A

United States Patent [19]

Hasegawa et al.

[11] Patent Number: 5,531,208

[45] Date of Patent: Jul. 2, 1996

[54] AIR-FUEL RATIO FEEDBACK CONTROL SYSTEM FOR INTERNAL COMBUSTION ENGINE

[75] Inventors: Yusuke Hasegawa; Isao Komoriya; Shusuke Akazaki; Eisuke Kimura, all of Wako, Japan

[73] Assignee: Honda Giken Kogyo Kabushiki Kaisha, Tokyo, Japan

[21] Appl. No.: 305,162

[22] Filed: Sep. 13, 1994

[30] Foreign Application Priority Data

Sep. 13, 1993 [JP] Japan ..... 5-251138

[51] Int. Cl.[6] ..... F02D 41/00

[52] U.S. Cl. ..... 123/673

[58] Field of Search ..... 123/673, 676, 123/434, 436

[56] References Cited

U.S. PATENT DOCUMENTS

| | | | |
|---|---|---|---|
| 4,418,672 | 12/1983 | Muller et al. | 123/673 |
| 5,131,371 | 7/1992 | Wahl et al. | 123/436 |
| 5,158,058 | 10/1992 | Yoshida et al. | 123/434 |
| 5,199,408 | 4/1993 | Wataya | 123/673 |

FOREIGN PATENT DOCUMENTS

| | | |
|---|---|---|
| 0553570A2 | 8/1993 | European Pat. Off. . |
| 59-101562 | 6/1984 | Japan . |
| 2-49948 | 2/1990 | Japan . |
| 3-149330 | 6/1991 | Japan . |
| 4-369471 | 12/1992 | Japan . |
| 5-180040 | 7/1993 | Japan . |

*Primary Examiner*—Raymond A. Nelli
*Attorney, Agent, or Firm*—Nikaido, Marmelstein, Murray & Oram

[57] ABSTRACT

A system for controlling an air-fuel ratio of an air-fuel mixture supplied to each cylinder of a multicylinder internal combustion engine. A first feedback loop is provided for converging a first air-fuel ratio at a location at least either at or downstream of a confluence point of an exhaust system to a first desired air-fuel ratio by multiplying a first feedback gain to a first error therebetween. And a second feedback loop is provided in the first loop for converging a second current air-fuel ratio at each cylinder to a second desired air-fuel ratio by multiplying a second feedback gain to a second error. The first feedback loop and said second feedback loop are connected in series such that the second loop located inside the first loop. With the arrangement. the second loop operates the second air-fuel ratio converges to converge the second air-fuel ratio to the first air-fuel ratio which in turn tends to converge on the first desired air-fuel ratio such that the air-fuel ratios of all cylinders can therefore be converged on the desired air-fuel ratio.

52 Claims, 19 Drawing Sheets

AIR-FUEL RATIO FEEDBACK CONTROL SYSTEM FOR INTERNAL COMBUSTION ENGINE

BACKGROUND OF THE INVENTION

1. Field of the Invention

This invention relates to an air-fuel ratio feedback control system for an internal combustion engine, more particularly to an air-fuel ratio feedback control system adapted for use in a multiple cylinder internal combustion engine for absorbing variance in air-fuel ratio between cylinders and converging the air-fuel ratio in each cylinder on a desired value with high accuracy.

2. Description of the Prior Art

It is a common practice to install an air-fuel ratio sensor in the exhaust system of an internal combustion engine and feedback-control the value detected by the sensor for regulating the amount of fuel supplied to a desired value. A system of this type is taught by Japanese Laid-open Patent Publication No. Sho 59-101562, for example.

When a single air-fuel ratio sensor is installed at an exhaust gas confluence point of the exhaust system of a multiple cylinder internal combustion engine with four, six or more cylinders, however, the output of the sensor represents a mixture of the values at all of the cylinders. Since the air-fuel ratios at the individual cylinders cannot be detected with high accuracy, therefore, they cannot be precisely controlled. As a result, the air-fuel mixture becomes lean at some cylinders and rich at others, and the quality of the exhaust emissions is degraded. While this problem can be overcome by installing a separate sensor for each cylinder, this increases costs to an unacceptable level and also gives rise to a problem regarding durability. In light of these circumstances, the assignee earlier proposed designing a model describing the exhaust system behavior, inputting the output of a single air-fuel ratio sensor disposed at the exhaust system confluence point to the model, and constructing an observer for estimating the air-fuel ratios at the individual cylinders. (Japanese Patent Application No. Hei 3-359338; Japanese Laid-open Patent Publication No. Hei 5-180040 which was filed in the United States under the number of 07/997,769 and in EPO under the number of 92311841.8)

It was found, however, that when the estimated values obtained in this manner are to be used for absorbing variance in air-fuel ratio between cylinders and converging the air-fuel ratio in each cylinder on a desired value with high accuracy, a problem arises regarding how the feedback gain (correction term or correction coefficient) should be set. For overcoming this problem, there is proposed conducting air-fuel ratio control by setting separate feedback gains for the individual cylinders and for all of the cylinders (confluence point) based on the output of a single $O_2$ sensor disposed at the exhaust system confluence point. (Japanese Laid-open Patent Publication No. Hei 3-149330)

Since this latter method does not use such a model as is describing the behavior of the exhaust system proposed earlier by the assignee, however, the accuracy of the air-fuel ratio control at the individual cylinders is insufficient. In addition, the $O_2$ sensor used for detecting the air-fuel ratio is not a wide-range air-fuel ratio sensor, namely, does produce an inverted output only in the vicinity of the stoichiometric air-fuel ratio and does not produce a detection output proportional to the oxygen concentration of the exhaust gas. Moreover, as the air-fuel ratio detection speed is slow, the method is also unsatisfactory in this respect.

This invention was accomplished for eliminating the aforesaid drawbacks of the prior art and its object is to provide an air-fuel ratio feedback control system for an internal combustion engine wherein absorption of variance in air-fuel ratio between cylinders and high-accuracy convergence on a desired value(s) of the air-fuel ratios in the individual cylinders are achieved by setting optimum feedback gains for the control based on the exhaust system confluence point air-fuel ratio and for the control based on the air-fuel ratios of the individual cylinders.

Another object of the invention is to provide an air-fuel ratio feedback control system for an internal combustion engine wherein the air-fuel ratios of the individual cylinders are feedback controlled to a desired value(s) with high accuracy using a model describing the behavior of the exhaust system and an observer.

Still another object of the invention is to provide an air-fuel ratio feedback control system for an internal combustion engine wherein even higher control accuracy is achieved without use of a model by feedback controlling the air-fuel ratios of the individual cylinders to a desired value(s) based on detected values produced by air-fuel ratio sensors disposed in the exhaust system in a number equal to the number of cylinders.

For realizing these objects, the present invention provides a system for controlling an air-fuel ratio of an air-fuel mixture supplied to each cylinder of a multicylinder internal combustion engine, including, a first feedback loop for converging a first air-fuel ratio at a location at least either at or downstream of a confluence point of an exhaust system to a first desired air-fuel ratio, and a second feedback loop for converging a second current air-fuel ratio at each cylinder to a second desired air-fuel ratio. The improvement comprises said first feedback loop and said second feedback loop are connected in series.

BRIEF DESCRIPTION OF THE DRAWINGS

These and other objects and advantages of the invention will be more apparent from the following description and drawings, in which.

DETAILED DESCRIPTION OF THE PREFERRED EMBODIMENTS

Figure 1:
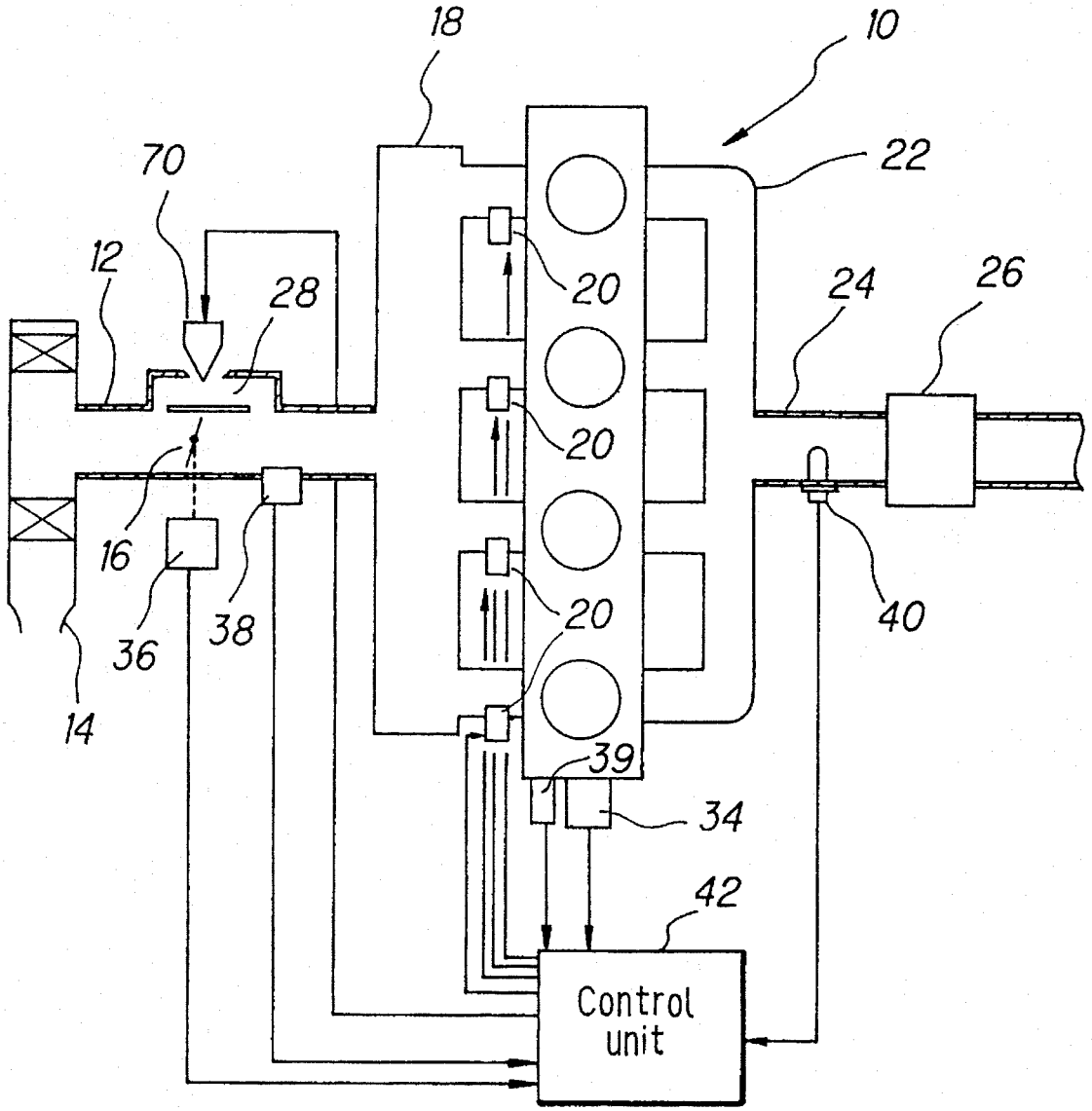
FIG. 1 is an overall schematic view of an air-fuel ratio feedback control system for internal combustion engine according to the present invention.

FIG. 1 is an overall schematic view of an air-fuel ratio feedback control system for an internal combustion engine according to this invention. Reference numeral 10 in this figure designates a four-cylinder internal combustion engine. Air drawn in through an air cleaner 14 mounted on the far end of an air intake passage 12 is supplied to the first to fourth cylinders through an intake manifold 18 while the flow thereof is adjusted by a throttle valve 16. An injector 20 for injecting fuel is installed in the vicinity of an intake valve (not shown) of each cylinder. The injected fuel mixes with the intake air to form an air-fuel mixture that is ignited in the associated cylinder by a spark plug (not shown). The resulting combustion of the air-fuel mixture drives down a piston (not shown). The exhaust gas produced by the combustion is discharged through an exhaust valve (not shown) into an exhaust manifold 22, from where it passes through an exhaust pipe 24 to a three-way catalytic converter 26 where it is removed of noxious components before being discharged to the exterior. In addition, the air intake path 12 is bypassed by a bypass 28 provided therein in the vicinity of the throttle valve 16.

A crankangle sensor 34 for detecting the piston crank angles is provided in an ignition distributor (not shown) of the internal combustion engine 10, a throttle position sensor 36 is provided for detecting the degree of opening of the throttle valve 16, and a manifold absolute pressure sensor 38 is provided for detecting the pressure of the intake air downstream of the throttle valve 16 as an absolute pressure. Additionally, a coolant water temperature sensor 39 is provided in a cylinder block (not shown) for detecting the temperature of a coolant water jacket (not shown) in the block. A wide-range air-fuel ratio sensor 40 constituted as an oxygen concentration detector is provided at a confluence point in the exhaust system between the exhaust manifold 22 and the three-way catalytic converter 26, where it detects the oxygen concentration of the exhaust gas at the confluence point and produces an output proportional thereto. The outputs of the crankangle sensor 34 and other sensors are sent to a control unit 42.

Figure 2:
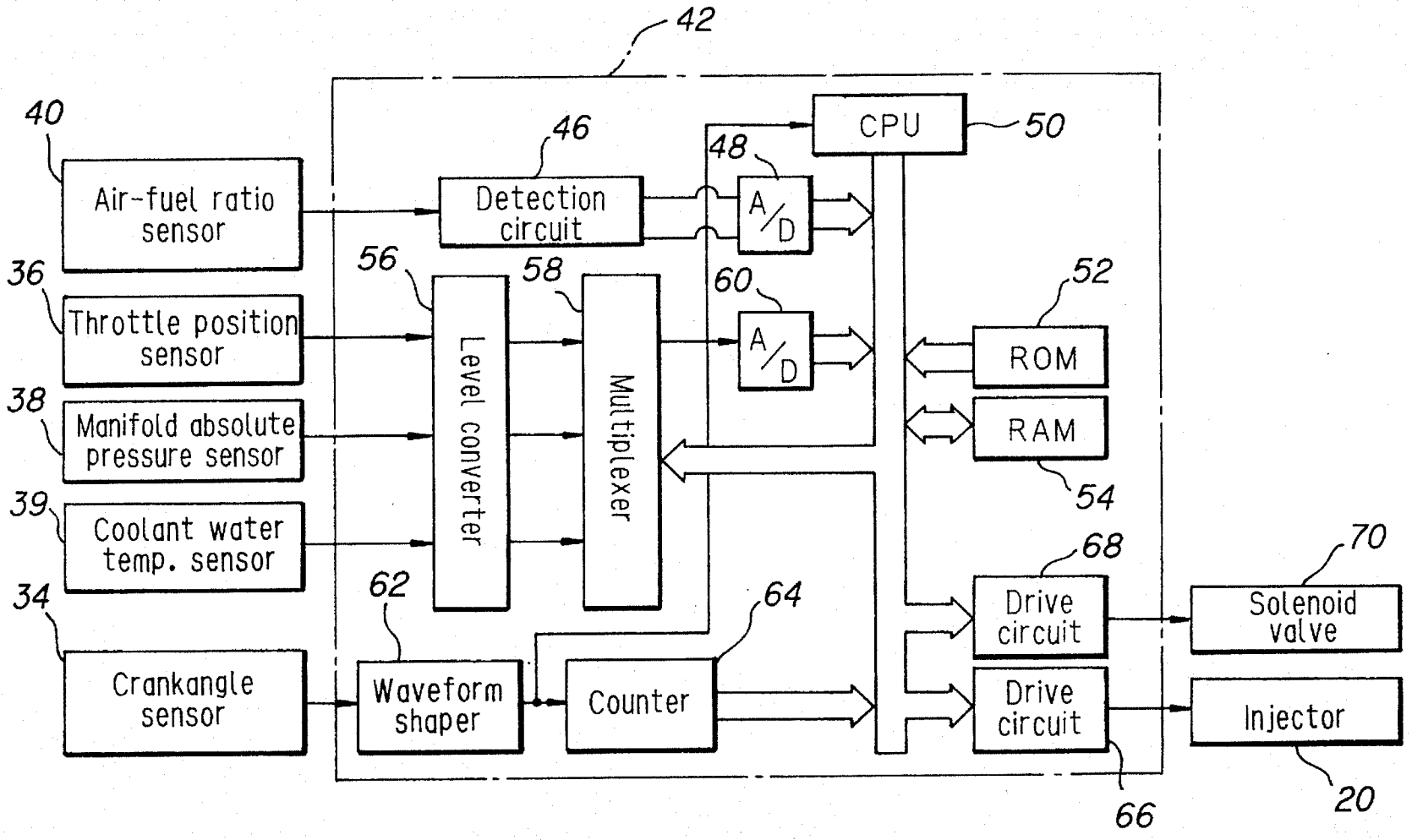
FIG. 2 is a block diagram showing the details of a control unit illustrated in FIG. 1.

Details of the control unit 42 are shown in the block diagram of FIG. 2. The output of the wide-range air-fuel ratio sensor 40 is received by a detection circuit 46 of the control unit 42, where it is subjected to appropriate linearization processing to obtain an air-fuel ratio (A/F) characterized in that it varies linearly with the oxygen concentration of the exhaust gas over a broad range extending from the lean side to the rich side. As this air-fuel ratio sensor is explained in detail in the assignee's Japanese Patent Application No. Hei 3-169456 (Japanese Laid-open Patent Publication No. Hei 4-369471 which was filed in the United States under the number of 07/878,596), it will not be explained further here. Hereinafter in this explanation, the air-fuel ratio sensor will be referred to as an LAF sensor (linear A-by-F sensor). The output of the detection circuit 46 is forwarded through an A/D (analog/digital) converter 48 to a microcomputer comprising a CPU (central processing unit) 50, a ROM (read-only memory) 52 and a RAM (random access memory) 54 and is stored in the RAM 54.

Similarly, the analogue outputs of the throttle position sensor 36 etc. are input to the microcomputer through a level converter 56, a multiplexer 58 and a second A/D converter 60, while the output of the crankangle sensor 34 is shaped by a waveform shaper 62 and has its output value counted by a counter 64, the result of the count being input to the microcomputer. In accordance with commands stored in the ROM 52, the CPU 50 of the microcomputer uses the detected values to compute a manipulated variable, drives the injectors 20 of the respective cylinders via a drive circuit 66 for controlling fuel injection and drives a solenoid valve 70 via a second drive circuit 68 for controlling the amount of secondary air passing through the bypass 28 shown in FIG. 1.

Figure 3:
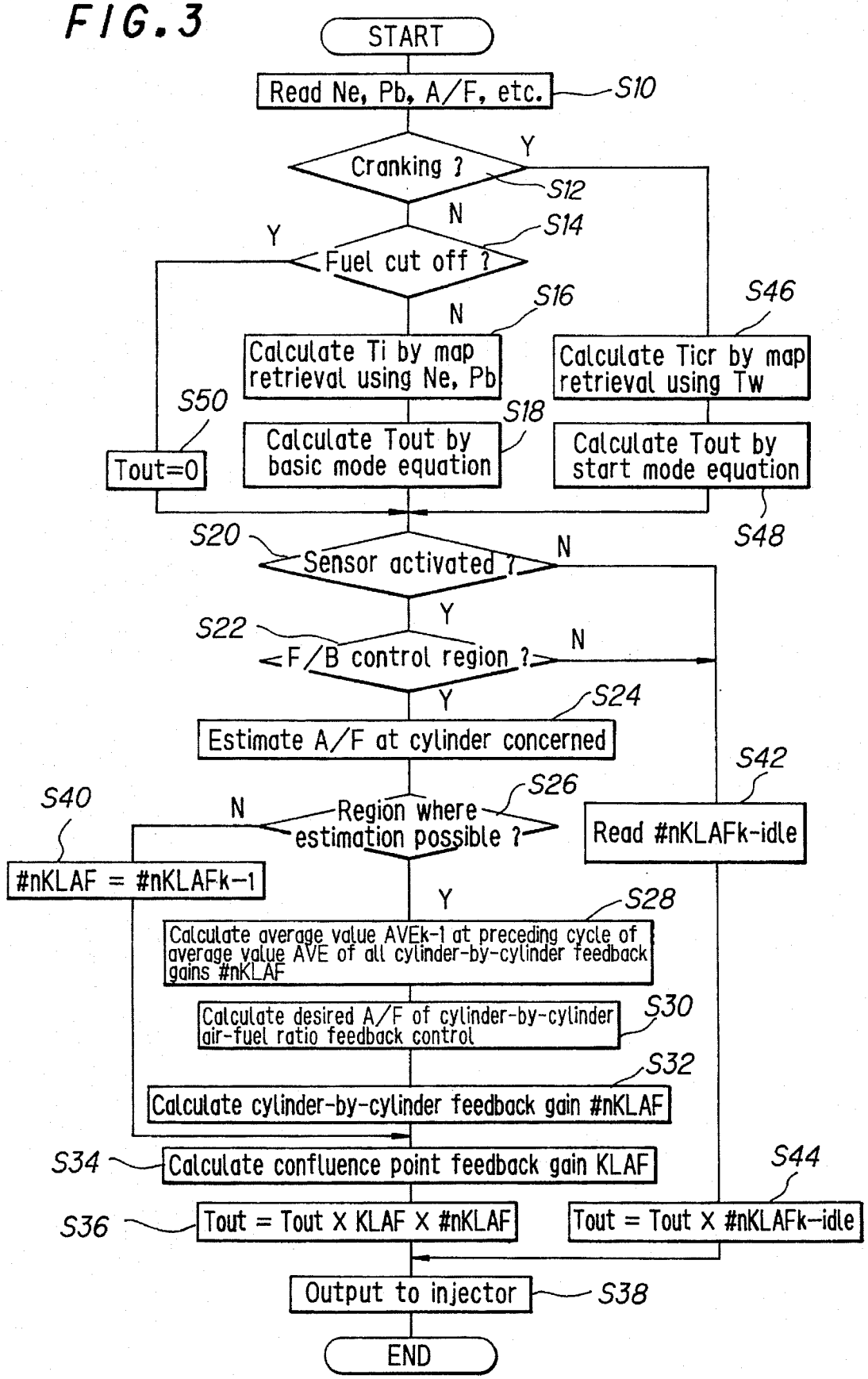
FIG. 3 is a flowchart showing the operation of the air-fuel ratio feedback control system for internal combustion engine illustrated in FIG. 1.

The operation of the system is shown by the flowchart of FIG. 3. For facilitating an understanding of the invention, however, the earlier proposed model describing the behavior of an exhaust system will be explained first.

Figure 4:
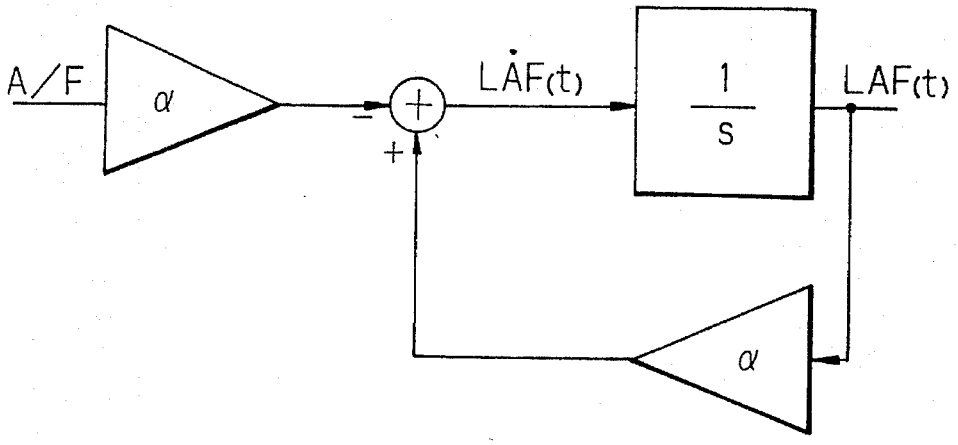
FIG. 4 is a block diagram showing a model describing the behavior of detection of an air-fuel ratio referred to in the assignee's earlier application.

For high-accuracy separation and extraction of the air-fuel ratios of the individual cylinders from the output of a single LAF sensor it is first necessary to accurately ascertain the detection response delay (lag time) of the LAF sensor. The inventors therefore used simulation to model this delay as a first-order lag time system. For this they designed the model shown in FIG. 4. Here, if we define LAF: LAF sensor output and A/F: input air-fuel ratio, the state equation can be written as $$\dot{LAF}(t)=\alpha LAF(t)-\alpha A/F(t) \quad (1)$$

When this is discretized for period delta T, we get $$LAF(k+1)=\hat{\alpha}LAF(k)+(1-\hat{\alpha})A/F(k) \quad (2)$$

Here:

$$\alpha=1+\alpha\Delta T+(1/2!)\alpha^2\Delta T^2+(1/3!)\alpha^3\Delta T^3+(1/4!)\alpha^4\ \Delta T^4$$

Figure 5:
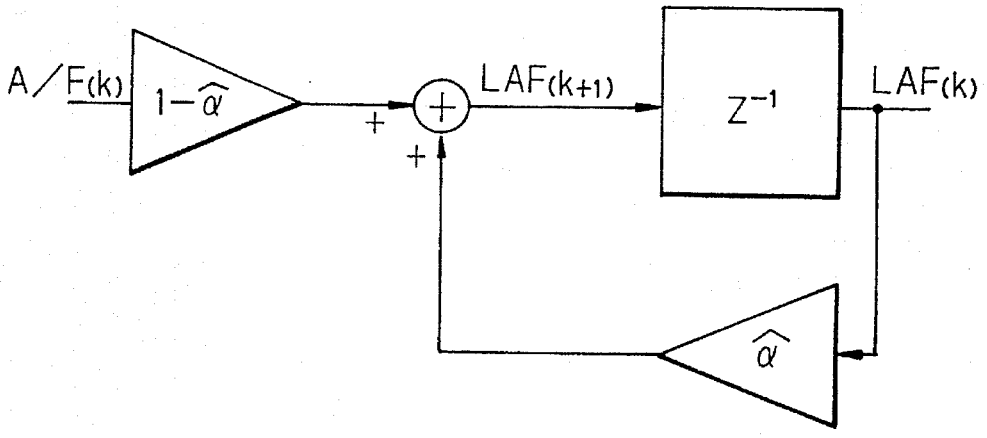
FIG. 5 is a block diagram showing the model of FIG. 4 discretized in the discrete-time series for period delta T.

Equation 2 is represented as a block diagram in FIG. 5.

Therefore, Equatior 2 can be used to obtain the actual air-fuel ratio from the sensor output. That is to say, since Equation 2 can be rewritten as Equation 3, the value at time k-1 can be calculated back from the value at time k as shown by Equation 4

$$A/F(k)=\{LAF(k+1)-\hat{\alpha}LAF(k)\}/(1-\hat{\alpha}) \quad (3)$$

$$A/F(k-1)=\{LAF(k)-\hat{\alpha}LAF(k-1)\}/(1-\hat{\alpha}) \quad (4)$$

Figure 6:
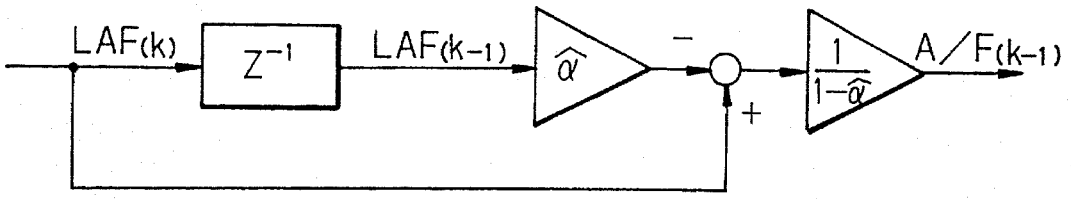
FIG. 6 is a block diagram showing a real-time air-fuel ratio estimator based on the model of FIG. 5.

Specifically, use of Z transformation to express Equation 2 as a transfer function gives Equation 5, and a real-time estimate of the air-fuel ratio input in the preceding cycle can be obtained by multiplying the sensor output LAF of the current cycle by the inverse transfer function. FIG. 6 is a block diagram of the real-time air-fuel ratio estimator.

$$t(z)=(1-\hat{\alpha})/(Z-\hat{\alpha}) \quad (5)$$

The method for separating and extracting the air-fuel ratios of the individual cylinders based on the actual air-fuel ratio obtained in the foregoing manner will now be explained. If the air-fuel ratio at the confluence point of the exhaust system is assumed to be an average weighted to reflect the time-based contribution of the air-fuel ratios of the individual cylinders, it becomes possible to express the air-fuel ratio at the confluence point at time k in the manner of Equation 6. (As F (fuel) was selected as the manipulated variable, the fuel-air ratio F/A is used here. For easier understanding, however, the air-fuel ratio will be used in the explanation so far as such usage does not lead to problems. The term "air-fuel ratio" (or "fuel-air ratio") used herein is the actual value corrected for the response lag time calculated according to Equation 5.)

$$\begin{aligned}
[F/A](k) &= C_1[F/A\#_1]+C_2[F/A\#_3]+ \\
&\quad C_3[F/A\#_4]+C_4[F/A\#_2] \\
[F/A](k+1) &= C_1[F/A\#_3]+C_2[F/A\#_4]+ \\
&\quad C_3[F/A\#_2]+C_4[F/A\#_1] \\
[F/A](k+2) &= C_1[F/A\#_4]+C_2[F/A\#_2]+ \\
&\quad C_3[F/A\#_1]+C_4[F/A\#_3] \\
&\ \ \vdots
\end{aligned} \quad (6)$$

Figure 7:
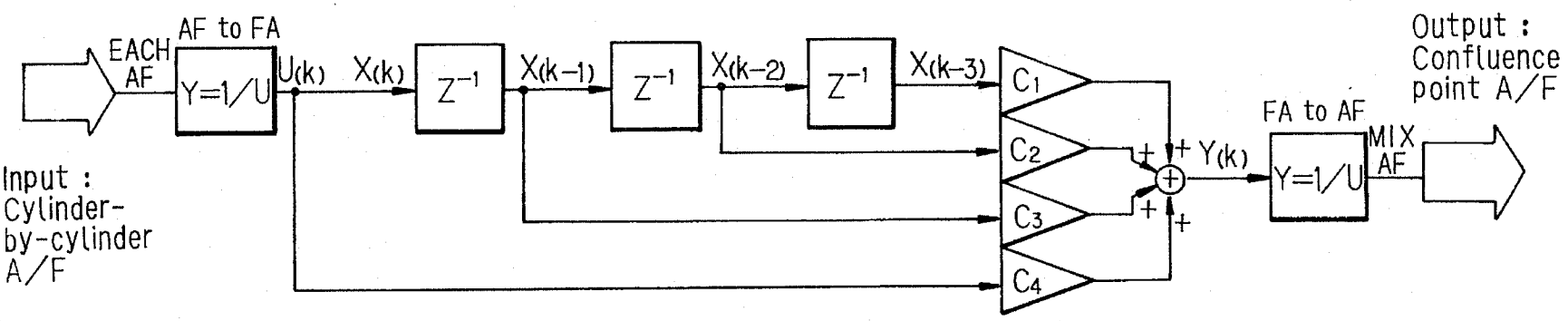
FIG. 7 is a block diagram showing a model describing the behavior of the exhaust system of the engine referred to in the assignee's earlier application.

More specifically, the air-fuel ratio at the confluence point can be expressed as the sum of the products of the past firing histories of the respective cylinders and weights C (for example, 40% for the cylinder that fired most recently, 30% for the one before that, and so on). This model can be represented as a block diagram as shown FIG. 7.

Its state equation can be written as $$\begin{pmatrix} x(k-2) \\ x(k-1) \\ x(k) \end{pmatrix} = \begin{pmatrix} 010 \\ 001 \\ 000 \end{pmatrix} \begin{pmatrix} x(k-3) \\ x(k-2) \\ x(k-1) \end{pmatrix} + \begin{pmatrix} 0 \\ 0 \\ 1 \end{pmatrix} u(k) \quad (7)$$

Further, if the air-fuel ratio at the confluence point is defined as y(k), the output equation can be written as $$y(k) = [c_1\ c_2\ c_3] \begin{pmatrix} x(k-3) \\ x(k-2) \\ x(k-1) \end{pmatrix} + c_4 u(k) \quad (8)$$

Here:

$c_1$:0.25379, $C_2$:0.10121, $C_3$:0.46111, $C_4$:0.18389

Since u(k) in this equation cannot be observed, even if an observer is designed from the equation, it will still not be possible to observe x(k). Thus, if one defines x(k+1)=x(k−3) on the assumption of a stable operating state in which there is no abrupt change in the air-fuel ratio from that 4 TDC earlier (i.e., from that of the same cylinder), Equation 9 is obtained.

$$\begin{pmatrix} x(k-2) \\ x(k-1) \\ x(k) \\ x(k+1) \end{pmatrix} = \begin{pmatrix} 0100 \\ 0010 \\ 0001 \\ 1000 \end{pmatrix} \begin{pmatrix} x(k-3) \\ x(k-2) \\ x(k-1) \\ x(k) \end{pmatrix} \quad (9)$$

$$y(k) = [c_1\ c_2\ c_3\ c_4] \begin{pmatrix} x(k-3) \\ x(k-2) \\ x(k-1) \\ x(k) \end{pmatrix}$$

Figure 8:
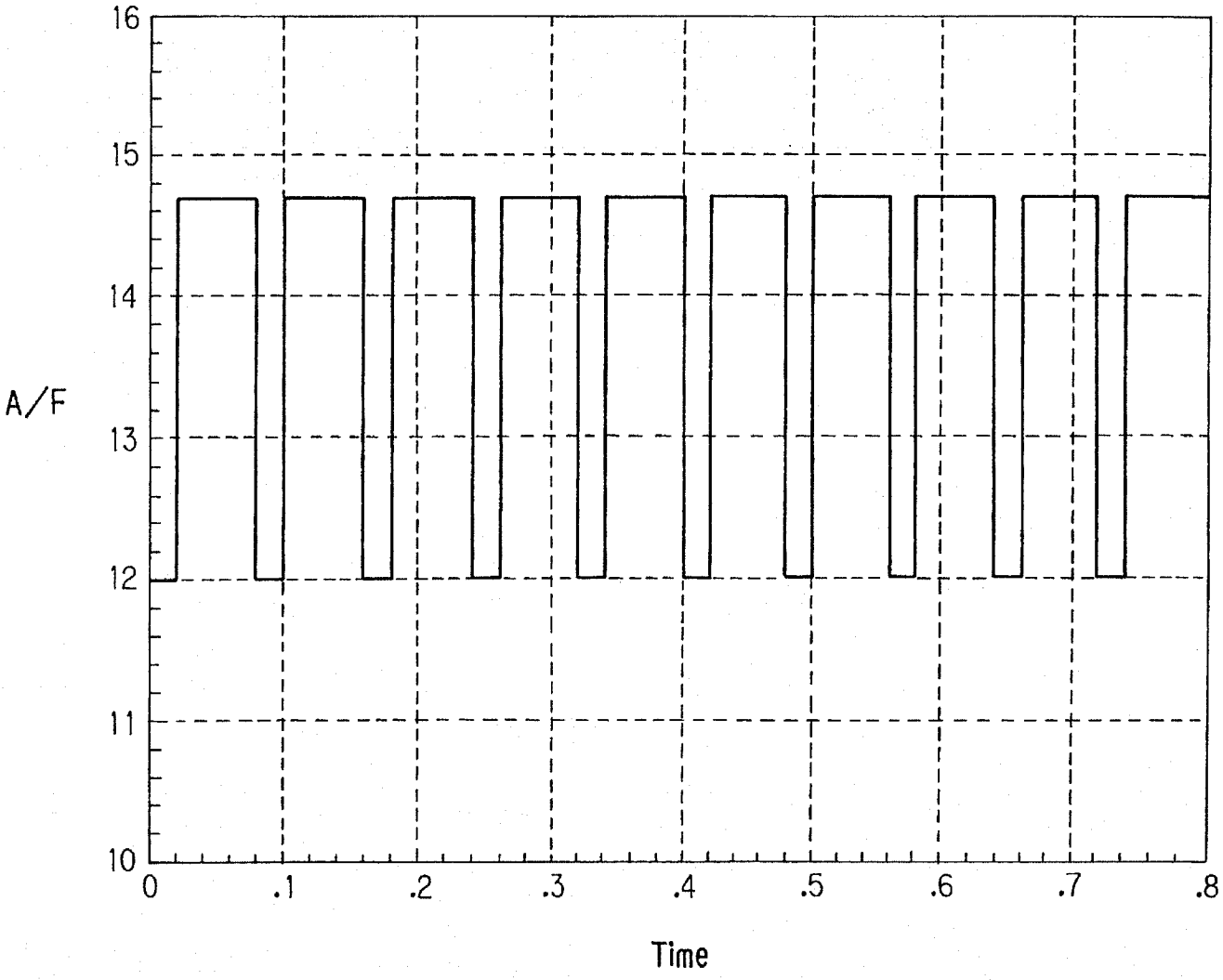
FIG. 8 is an explanatory view of simulation such that fuel is assumed to be supplied to three cylinders of a four-cylinder engine so as to obtain an air-fuel ratio of 14.7 : 1 and to one cylinder so as to obtain an air-fuel ratio of 12.0: 1.
Figure 9:
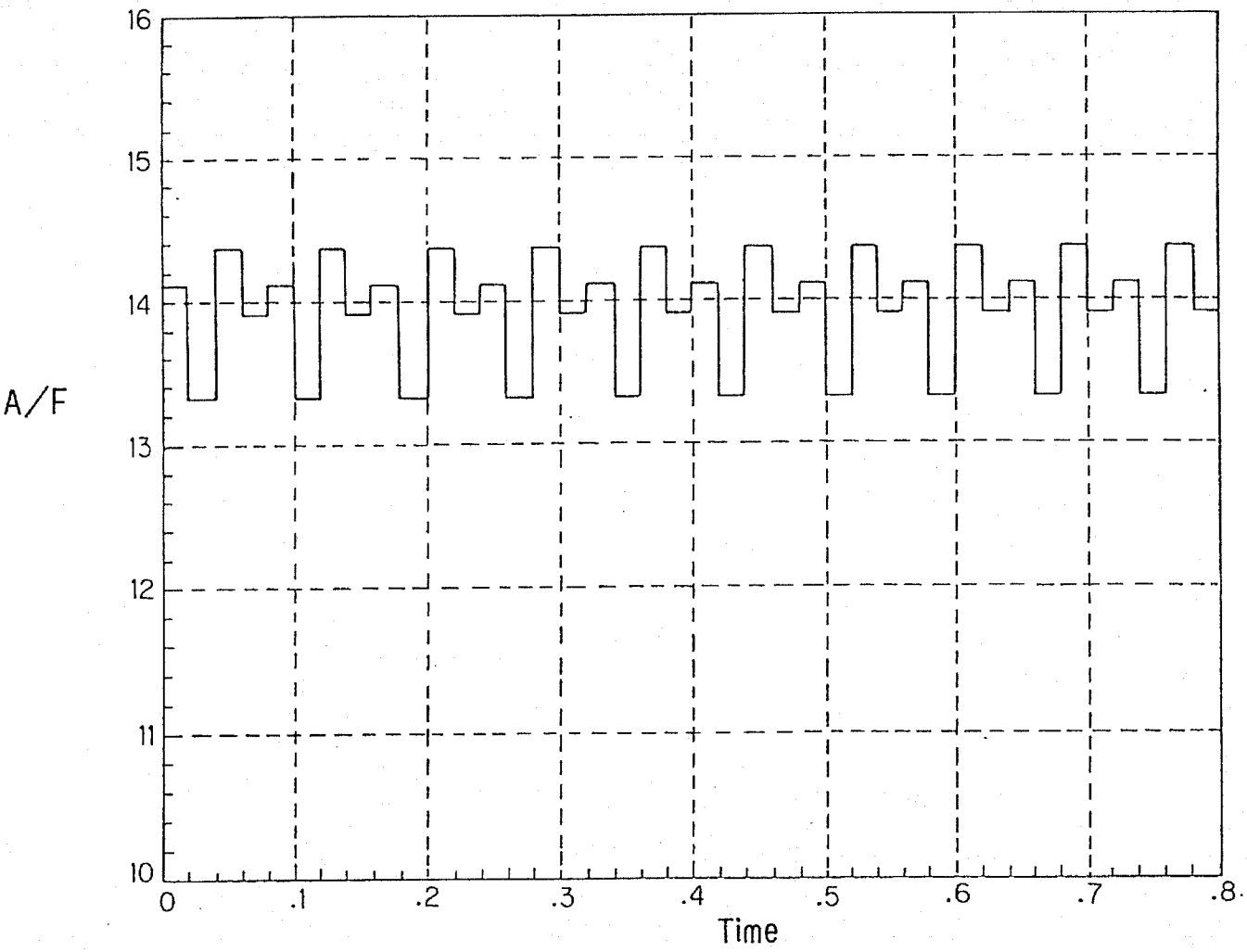
FIG. 9 is the result of the simulation showing the output of the exhaust system model indicative of the air-fuel ratio at a confluence point when the fuel is supplied in the manner illustrated in FIG. 8.
Figure 10:
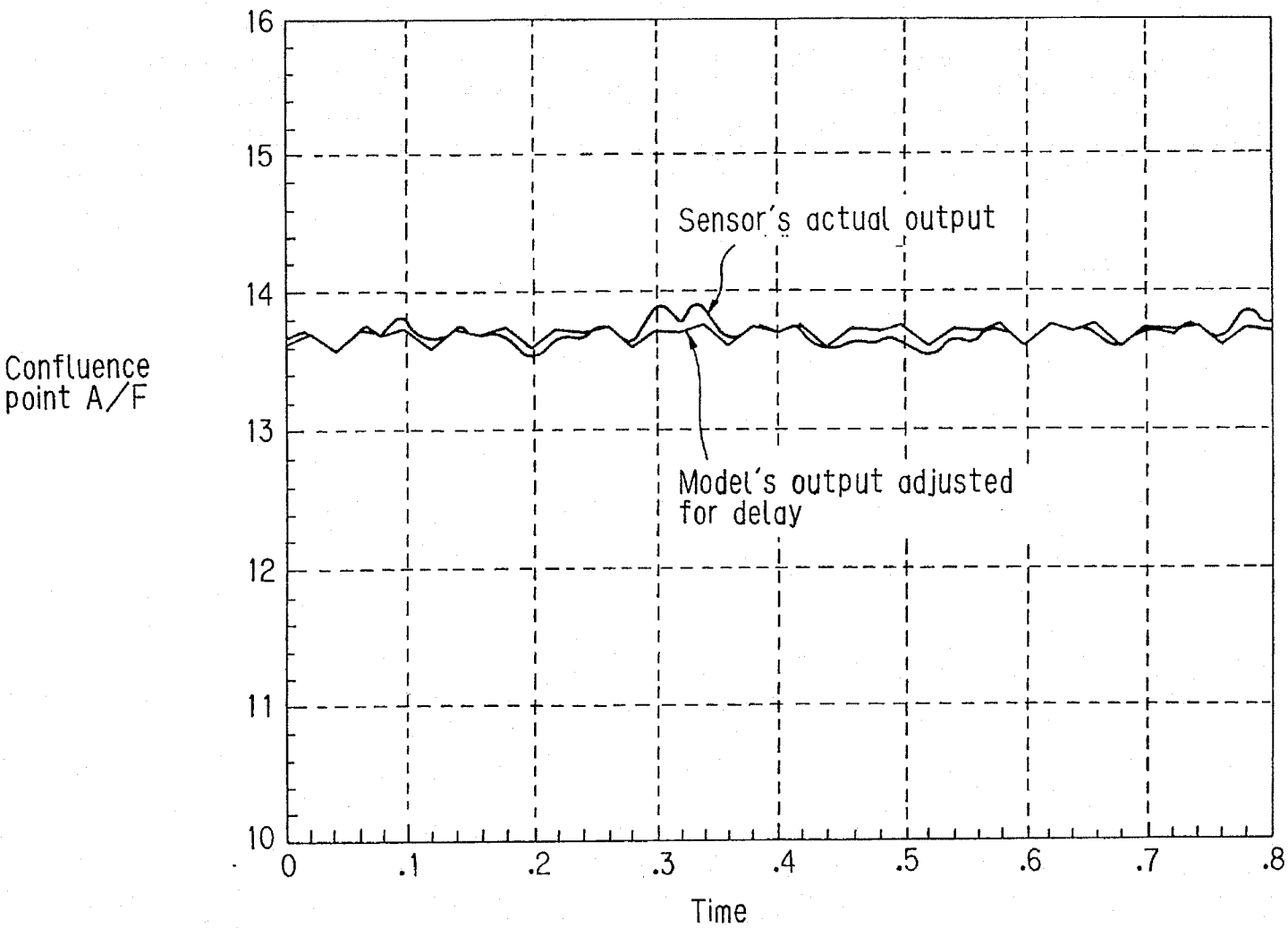
FIG. 10 is the result of the simulation showing the output of the exhaust system model adjusted for sensor detection response delay (time lag) in contrast with the sensor's actual output.

The simulation results for the model obtained in the foregoing manner will now be given. FIG. 8 relates to the case where fuel is supplied to three cylinders of a four-cylinder internal combustion engine so as to obtain an air-fuel ratio of 14.7: 1 and to one cylinder so as to obtain an air-fuel ratio of 12.0: 1. FIG. 9 shows the air-fuel ratio at this time at the confluence point as obtained using the aforesaid model. While FIG. 9 shows that a stepped output is obtained, when the response delay (lag time) of the LAF sensor is taken into account, the sensor output becomes the smoothed wave designated "Model's output adjusted for delay" in FIG. 10. The curve marked "Sensor's actual output" is based on the actually observed output of the LAF sensor under the same conditions. The close agreement of the model results with this verifies the validity of the model as a model of the exhaust system of a multiple cylinder internal combustion engine.

Thus, the problem comes down to one of an ordinary Kalman filter in which x(k) is observed in the state equation, Equation 10, and the output equation. When the weighted matrices Q, R are determined as in Equation 11 and the Riccati's equation is solved, the gain matrix K becomes as shown in Equation 12.

$$A \begin{pmatrix} 0100 \\ 0010 \\ 0001 \\ 1000 \end{pmatrix} \quad C=[c_1 c_2 c_3 c_4] \quad B=D=[0]$$

-continued $$X(k)=\begin{pmatrix} x(k-3) \\ x(k-2) \\ x(k-1) \\ x(k) \end{pmatrix}$$

$$Q=\begin{pmatrix} 1000 \\ 0100 \\ 0010 \\ 0001 \end{pmatrix} \quad R=[1] \tag{11}$$

$$K=\begin{pmatrix} -0.3093 \\ 1.1918 \\ 0.3093 \\ 0.0803 \end{pmatrix} \tag{12}$$

Obtaining A-KC from this gives Equation 13.

$$A-KC=\begin{pmatrix} 0.0785 & 1.0313 & 0.1426 & 0.0569 \\ -0.3025 & -0.1206 & 0.4505 & -0.2192 \\ -0.0785 & -0.0313 & -0.1426 & 0.9431 \\ 0.9796 & -0.0081 & -0.0370 & -0.0148 \end{pmatrix} \tag{13}$$

Figure 11:
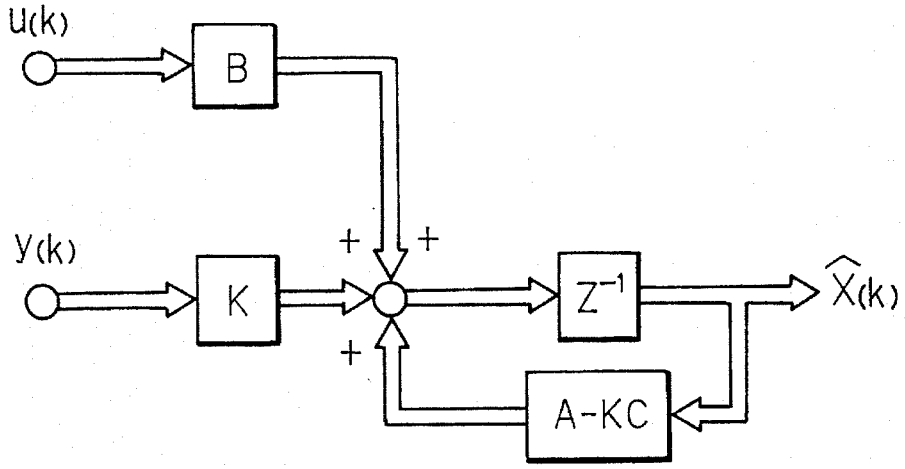
FIG. 11 is a block diagram showing the configuration of an ordinary observer.
Figure 12:
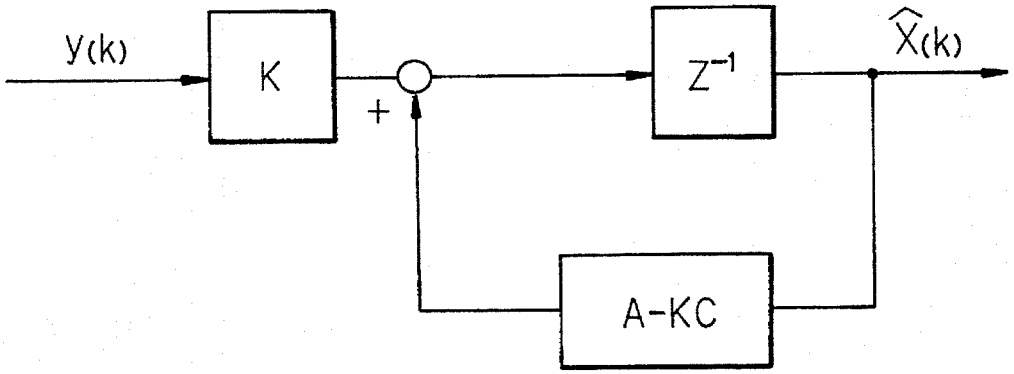
FIG. 12 is a block diagram showing the configuration of the observer referred to in the assignee's earlier application.

FIG. 11 shows the configuration of an ordinary observer. Since there is no input u(k) in the present model, however, the configuration has only y(k) as an input, as shown in FIG. 12. This is expressed mathematically by Equation 14.

$$\begin{cases} \hat{X}(k+1) = [A-KC]\hat{X}(k)+Ky(k) \\ \hat{x}(k) = [0001]\begin{pmatrix} \hat{x}(k-3) \\ \hat{x}(k-2) \\ \hat{x}(k-1) \\ \hat{x}(k) \end{pmatrix} \end{cases} \tag{14}$$

The system matrix of the observer whose input is y(k), namely of the Kalman filter, is $$S=\left(\begin{array}{c|c} A-KC & K \\ \hline 0001 & 0 \end{array}\right) \tag{15}$$

In the present model, when the ratio of the member of the weighted distribution R in Riccati's equation to the member of Q is 1: 1, the system matrix S of the Kalman filter is given as $$S=\begin{pmatrix} 0.0785 & 1.0313 & 0.1426 & 0.0569 & -0.3093 \\ -0.3025 & -0.1206 & 0.4505 & -0.2192 & 1.1918 \\ -0.0785 & -0.0313 & -0.1426 & 0.9431 & 0.3093 \\ 0.9796 & -0.0081 & -0.0370 & -0.0148 & 0.0803 \\ 0.0 & 0.0 & 0.0 & 1.0 & 0.0 \end{pmatrix} \tag{16}$$

Figure 13:
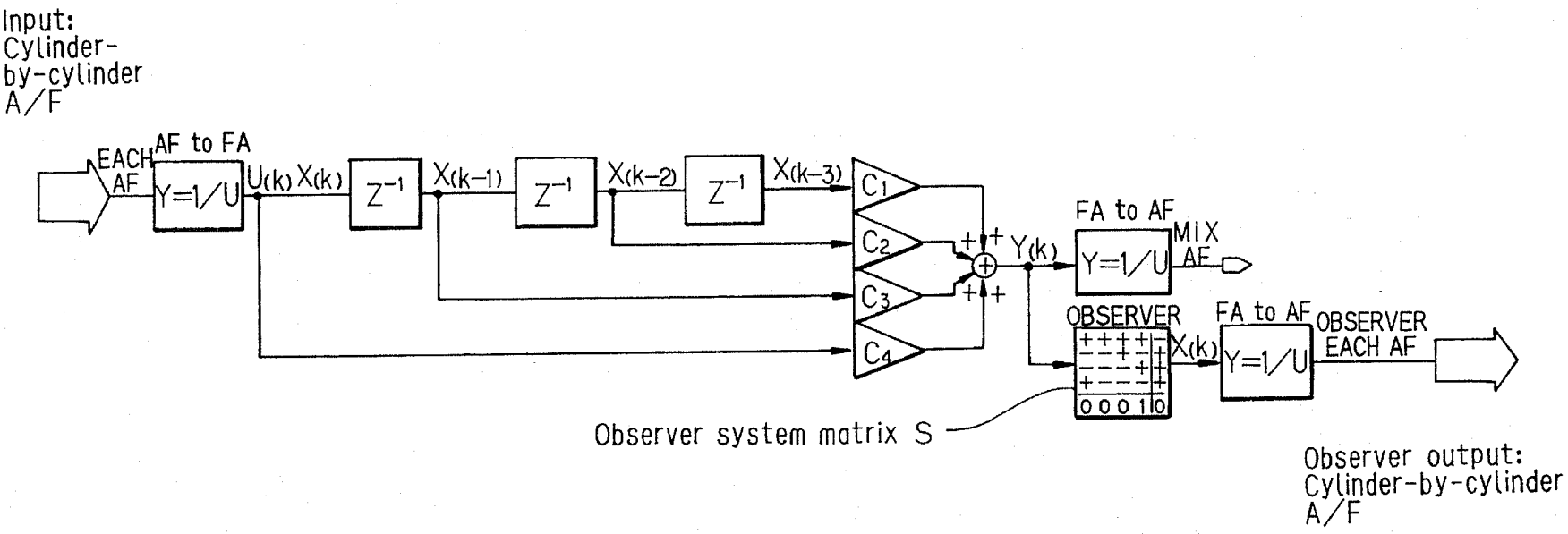
FIG. 13 is an explanatory block diagram showing the configuration combining the model of FIG. 7 and the observer of FIG. 12.

FIG. 13 shows the configuration in which the aforesaid model and observer are combined. As this was described in detail in the assignee's earlier application, further explanation is omitted here.

Figure 14:
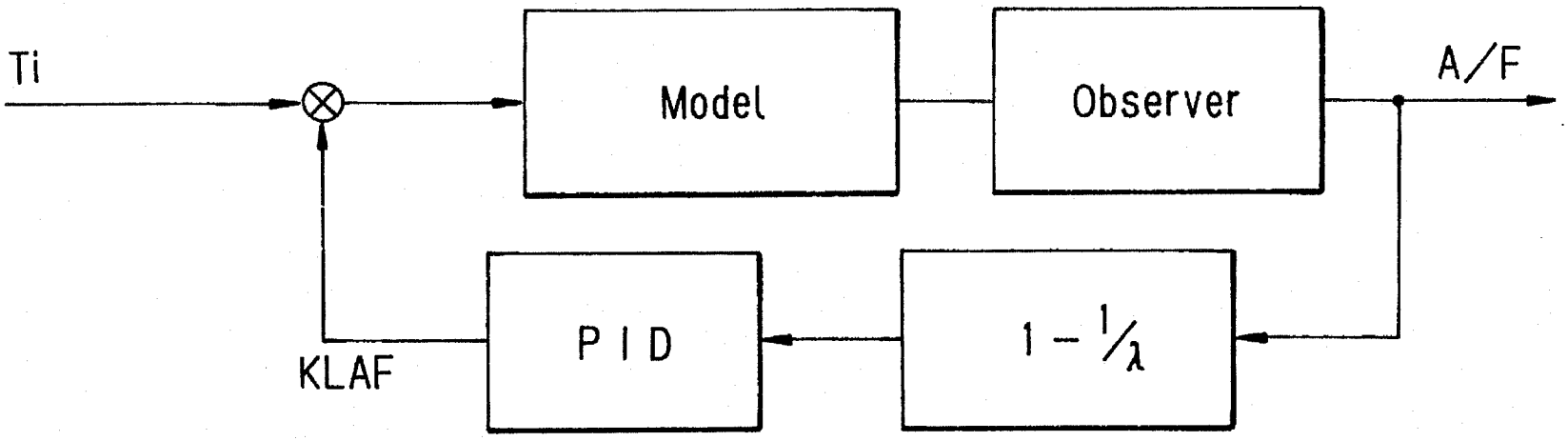
FIG. 14 is a block diagram showing an air-fuel ratio feedback control in which the air-fuel ratio is controlled to a desired ratio through a PID controller.
Figure 15:
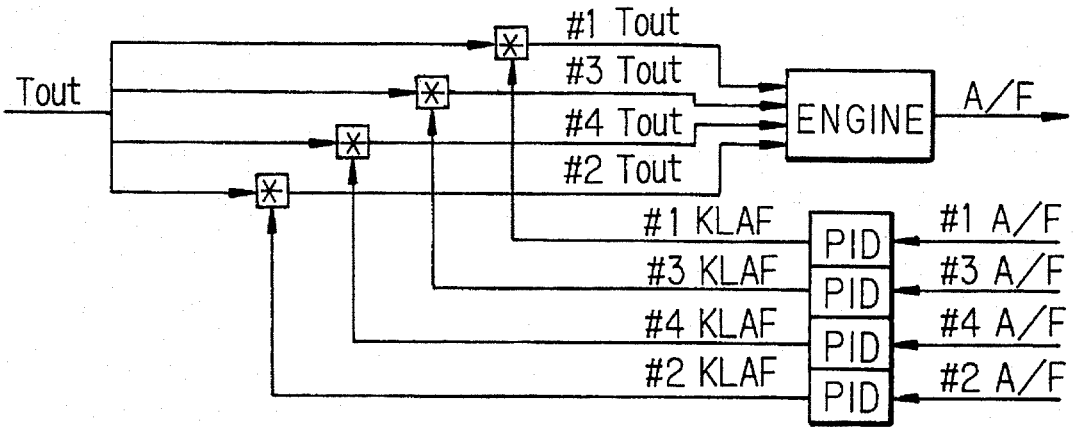
FIG. 15 is a block diagram showing the configuration of the air-fuel ratio feedback control system illustrated in FIG. 14 more specifically.

Since the observer is able to estimate the cylinder-by-cylinder air-fuel ratio (each cylinder's air-fuel ratio) from the air-fuel ratio at the confluence point, the air-fuel ratios of the individual cylinders can, as shown in FIG. 14, be separately controlled by a PID controller or the like. A more specific configuration for feedback controlling the air-fuel ratio of the individual cylinders is shown in FIG. 15.

Figure 16:
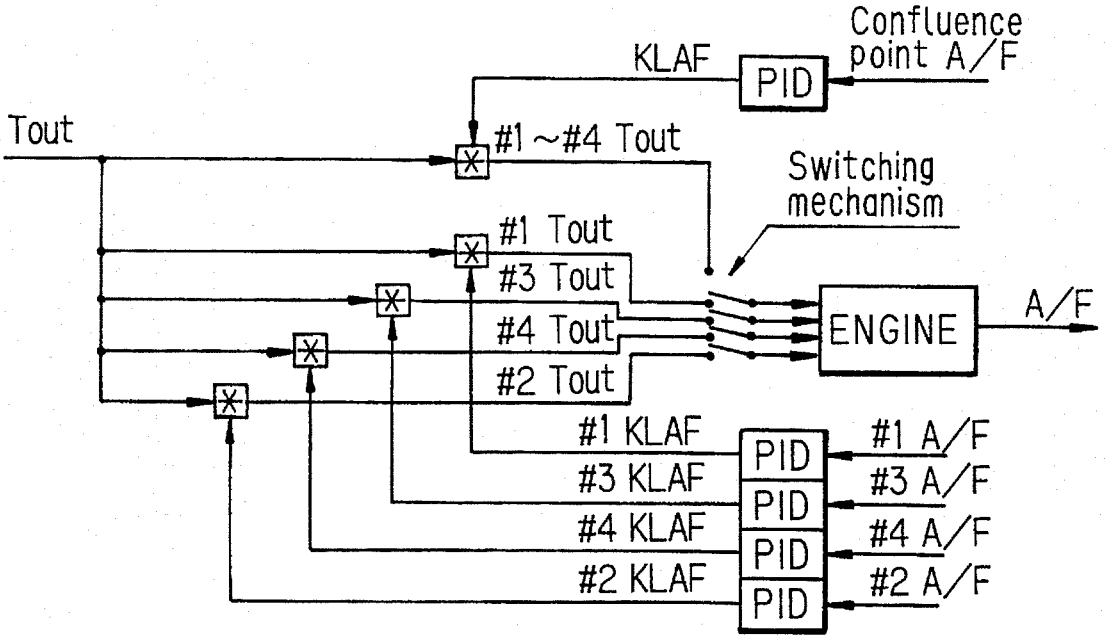
FIG. 16 is a block diagram showing the configuration of an air-fuel ratio feedback control system obtained by modifying the configuration illustrated in FIG. 15.

The observer cannot be implemented over the full operating range, however, because the estimation error becomes too large or estimation becomes impossible owing to the effect of the LAF sensor characteristics etc., especially in the high-speed range where the computation time is short. This leads to the idea of a combined arrangement in which feedback control is implemented on the basis of the confluence point air-fuel ratio in regions where observer estimation is impossible. As shown in FIG. 16, this can be achieved by switching between feedback gains before and after the regions in which estimation is impossible. More specifically, a feedback gain KLAF for the control based on the confluence point air-fuel ratio and a feedback gains #nKLAF (n: cylinder concerned) for the control based on the cylinder-by-cylinder (each cylinder) air-fuel ratio can be separately defined, the correction in the regions where estimation is possible be effected by multiplying the injected quantity of fuel Tout by the cylinder-by-cylinder feedback gain #nKLAF concerned, and the correction in the regions where estimation is not possible be effected by switching to the confluence point feedback gain KLAF and multiplying the injected quantity of fuel Tout by it. It should be noted here that the feedback gains are not added to the input as is often experienced in an ordinary control, but is multiplied to the input such that the control response is enhanced.

When simulation was conducted using this method, however, the changeover between feedback gains KLAF and #nKLAF of different values produced a sudden change in the injected quantity of fuel, which in turned caused a large fluctuation in the air-fuel ratio. Nevertheless, it is believed that insofar as the observer configuration does not provide perfect estimation across the entire operation range, as is presently the situation, it is impossible to eliminate the control based on the confluence point air-fuel ratio.

Figure 17:
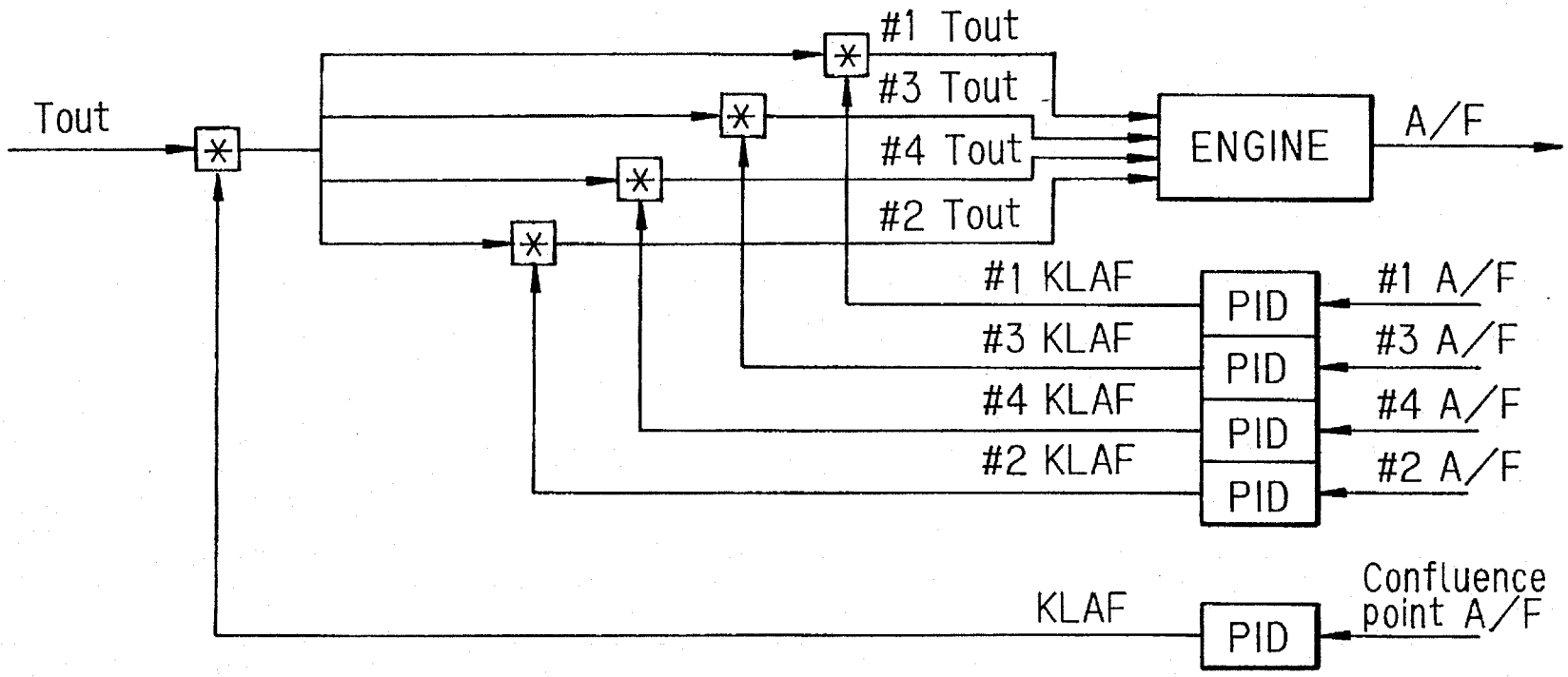
FIG. 17 is a block diagram showing the configuration of an air-fuel ratio feedback control system obtained by modifying the configuration illustrated in FIG. 16.

Therefore, as shown in FIG. 17, the cylininder-by-cylinder air-fuel ratio feedback loop was established inside the confluence point air-fuel ratio feedback loop and the two were connected in series for constantly providing two feedback loops. (In the regions where estimation is impossible, the cylinder-by-cylinder feedback gain is held at the value in the preceding cycle.)

Figure 18:
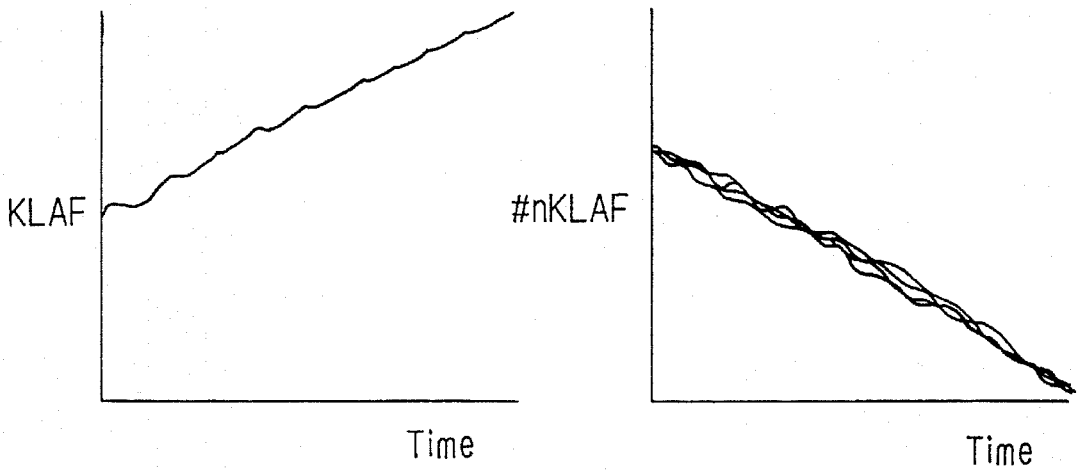
FIG. 18 is timing charts showing that feedback gains in the configuration of FIG. 17 diverge from each other.

When the validity of this configuration was checked by simulation, however, divergence was found to occur owing to interference between the cylinder-by-cylinder feedback gain and the confluence point feedback gain. More specifically, as shown in FIG. 18, when one of the feedback gains increased slightly, the other decreased, causing the first to increase further. As a result, the two feedback gains KLAF and #nKLAF progressively separated until finally reaching and remaining at their limits, making control impossible. The arrangement was, however, found to eliminate the sudden change in air-fuel ratio at changeover.

Figure 19:
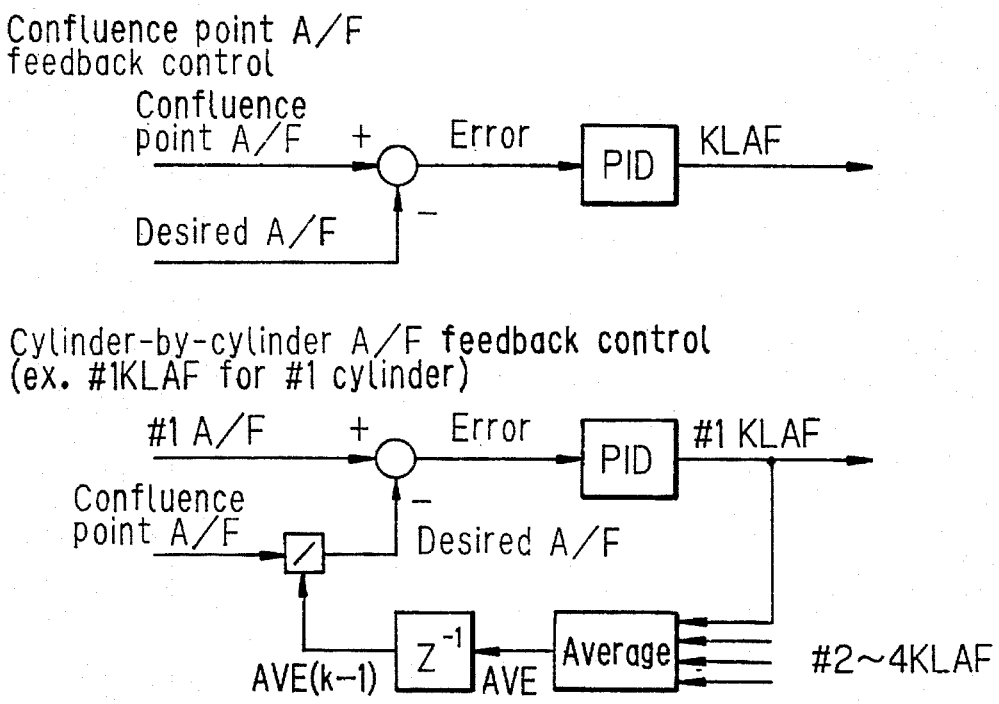
FIG. 19 is a block diagram showing the configuration of an air-fuel ratio feedback control system according to the present invention by modifying the configuration of FIG. 17.
Figure 20:
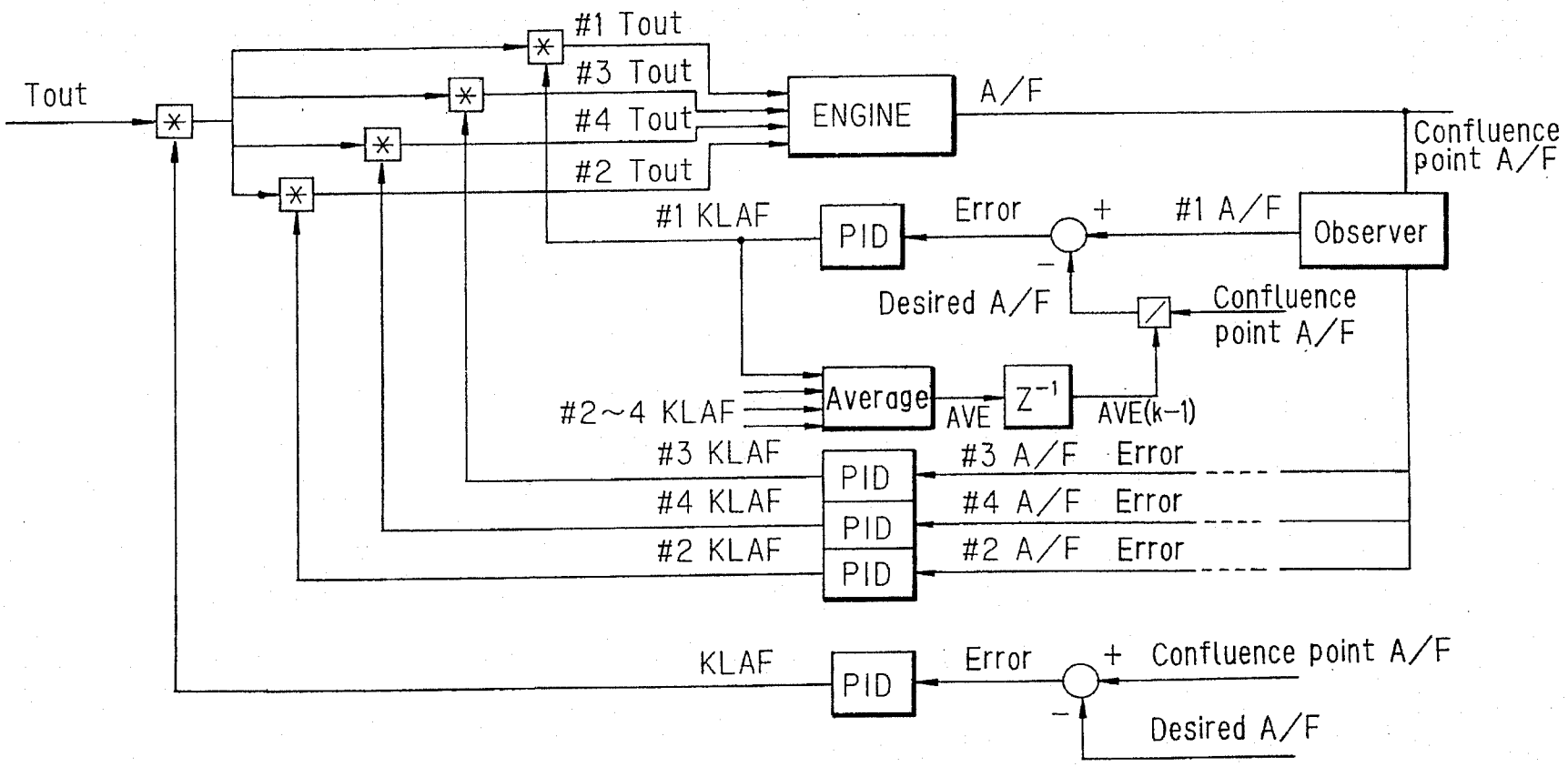
FIG. 20 is a block diagram shown the overall configuration of the air-fuel ratio feedback control system of FIG. 19.
Figure 21:
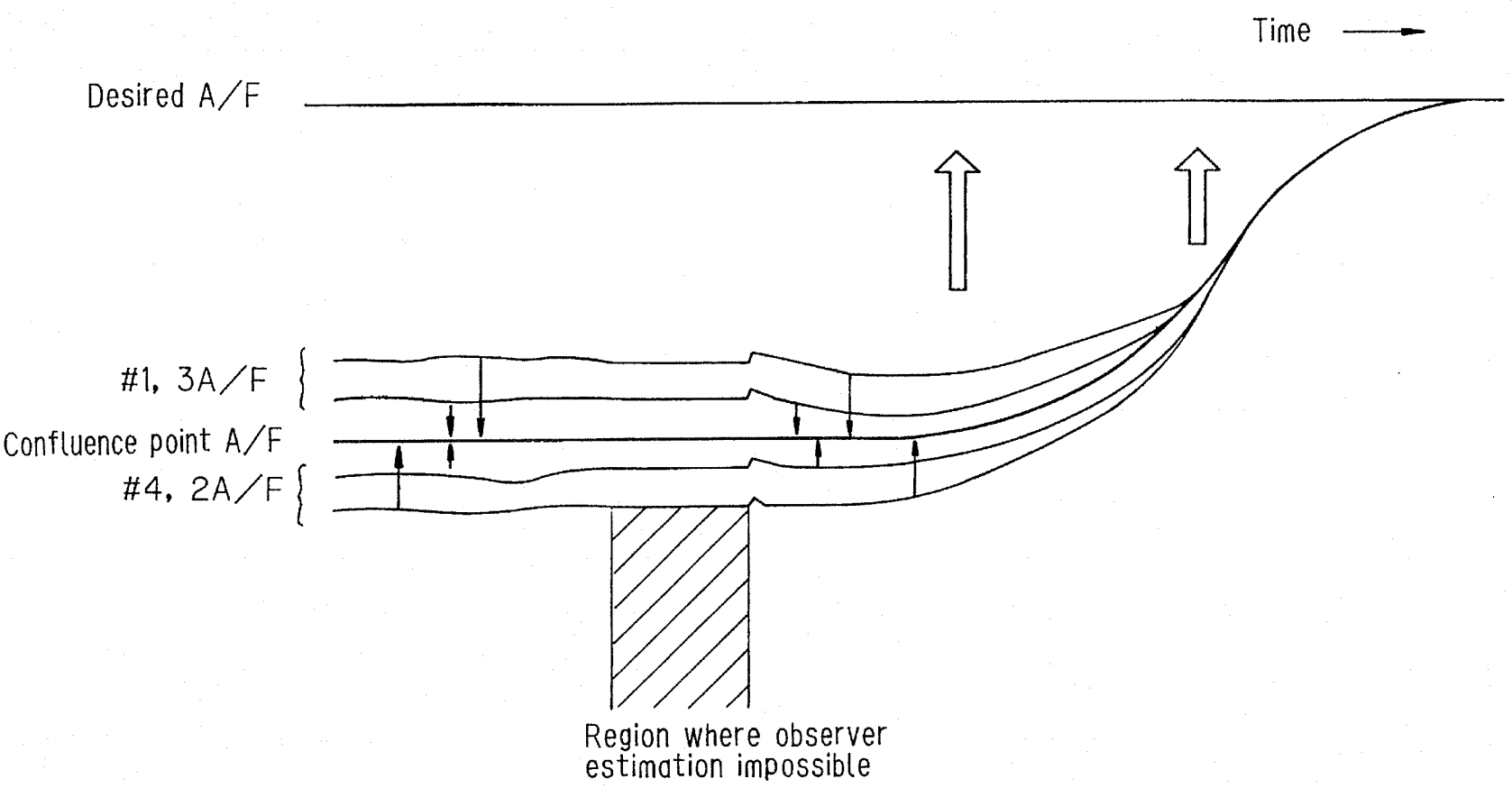
FIG. 21 is a timing chart showing the operation of the air-fuel ratio feedback control system illustrated in FIGS. 19 and 20.

Accordingly, the configuration shown in FIG. 19 is adopted. In this configuration, only the variance between cylinders is absorbed by the cylinder-by-cylinder air-fuel ratio feedback gains #nKLAF and the error from the desired air-fuel ratio is absorbed by the confluence point air-fuel ratio feedback gain KLAF. More specifically, as in the prior art the desired value used in the confluence point air-fuel ratio feedback control is the desired air-fuel ratio, while the cylinder-by-cylinder air-fuel ratio feedback control arrives at its desired value by dividing the confluence point air-fuel ratio by the average value AVEk-1 in the preceding cycle of the average value AVE of the cylinder-by-cylinder feedback gains #nKLAF of the whole cylinders. FIG. 20 shows the overall configuration of the system illustrated in FIG. 19. With this arrangement, as shown in FIG. 21, the cylinder-by-cylinder feedback gains #nKLAF operate to converge the cylinder-by-cylinder air-fuel ratios on the confluence point air-fuel ratio and, moreover, since the average value AVE of the cylinder-by-cylinder feedback gains tends to converge on 1.0, the gains do not diverge and the variance between cylinders is absorbed as a result. On the other hand, since the confluence point air-fuel ratio converges on the desired air-fuel ratio, the air-fuel ratios of all cylinders can therefore be converged on the desired air-fuel ratio.

This is because when the cylinder-by-cylinder feedback gains #nKLAF are all set to 1.0 in the configuration of the cylinder-by-cylinder air-fuel ratio feedback loop shown in FIG. 19 or FIG. 20, the operation continues until the feedback loop error disappears, i.e. until the denominator (the average value of the cylinder-by-cylinder feedback gains #nKLAF) becomes 1.0, a state indicating that the variance in air-fuel ratio between cylinders has been eliminated. (Although the figures starting from FIG. 15 deal with A/F (the air-fuel ratio), the same principle can also be applied to F/A (the fuel-air ratio).

Based on the foregoing, the operation of the system according to the invention will now be explained with reference to the flowchart of FIG. 3. The program of this flowchart determines the fuel injection quantity for a cylinder once every prescribed crankangle from TDC in the firing order of the cylinders (#1, #3, #4, #2). In the following explanation, the determination of the fuel injection quantity of the first cylinder is taken as an example.

First, the engine speed Ne, the manifold absolute pressure Pb and the detected A/F (air-fuel ratio) are read in a step S10. The detected air-fuel ratio here is the air-fuel ratio at the exhaust system confluence point.

Discrimination is then made in a step S12 as to whether or not the engine is cranking, and if it is not, a discrimination is made in a step S14 as to whether or not the fuel supply has been cut off. If the result of the discrimination is negative, a basic fuel injection quantity Ti is calculated in a step S16 by retrieval from a map prepared beforehand using the engine speed Ne and the manifold absolute pressure Pb as address data, and the injected quantity of fuel Tout is then calculated in a step S18 in accordance with a basic mode equation. The output fuel injection quantity Tout in basic mode is calculated as Output fuel injection quantity Tout=Basic fuel injection quantity Ti x Correction coefficients+Additive correction terms.

The "correction coefficients" in this equation include a coolant water temperature correction coefficient, an acceleration increase correction coefficient and the like but not the confluence point air-fuel ratio feedback gain KLAF and the cylinder-by-cylinder air-fuel ratio feedback gains #nKLAF. The "additive correction terms" include a battery voltage drop correction term and the like.

Next, a discrimination is made in a step S20 as to whether or not activation of the LAF sensor 40 has been completed, and if it has, another discrimination is made in a step S22 whether or not the current engine operation is in a region where the feedback control is permitted. If the engine is being wide-open throttled, or is at a higher engine speed or Exhaust Gas Recirculation is in progress, the feedback control is not permitted.

If the decision at the step S22 is affirmative, the air-fuel ratio of the cylinder is estimated through the output of the aforesaid observer in a step S24 and a discrimination is made in a step S26 as to whether or not the engine operation is in a region where observer estimation is impossible. The regions where estimation is impossible are determined from the engine speed Ne and the manifold absolute pressure Pb and mapped in advance. The decision in the step S26 is made by retrieval from the map using the engine speed Ne and the manifold absolute pressure Pb as address data. Typical regions in which estimation is impossible are the high engine speed region and the low load region.

If the step S26 finds estimation to be possible, a step S24 calculates the aforesaid average value AVEk-1 in the preceding cycle of the average value AVE of the cylinder-by-cylinder feedback gains #nKLAF of the all cylinders. The average value in the preceding cycle is used because the gain #1KLAF for the first cylinder in the current cycle is not yet available for calculating the average. Next, in a step S30, the confluence point air-fuel ratio (detected value) is divided by the average value AVEk-1 to obtain the desired air-fuel ratio of the cylinder-by-cylinder air-fuel ratio feedback control and the gain #nKLAF (n: 1) is then calculated in a step S32 using the PID controller.

In the following step S34, the error of the confluence point air-fuel ratio (detected based on the output of the LAF sensor 40) from the desired air-fuel ratio (is set at stoichiometric air-fuel ratio in the embodiment) is calculated, and the confluence point feedback gain KLAF is calculated using the PID controller. The output fuel injection quantity Tout for the first cylinder is then corrected in a step S36 by multiplying it by the two gains KLAF and #nKLAF, whereafter the valve of the injector 20 of the first cylinder is opened for a period corresponding to the corrected value in a step S38.

On the other hand, when the step 26 finds the operation to be in a region where observer estimation is impossible, the value of the cylinder-by-cylinder feedback gain #nKLAF is held at the preceding cycle value #nKLAFk-1. In other words, it is fixed at the value immediately before entry into the region where estimation is impossible and the held value is used to correct the output fuel injection quantity by multiplication in the step S36. This is for avoiding the sudden change in air-fuel ratio referred to earlier that otherwise occur when the cylinder-by-cylinder feedback gain is replaced with the confluence point feedback gain, for example.

Moreover, although the method in which the gains #nKLAF are determined is also a factor, the fact that the variance in air-fuel ratio between cylinders is by nature generally small makes it possible to assume that the value of the cylinder-by-cylinder feedback gains #nKLAF will be values in the vicinity of unity that are smaller than that of the confluence point feedback gain KLAF. In view of the anticipated performance of the observer, the presence of regions in which estimation is impossible cannot be avoided. By using the value of the relatively small cylinder-by-cylinder feedback gain #nKLAFk-1 just before entry into such a region, however, it is possible to reduce the amount of fluctuation in the air-fuel ratio. For the same reason, instead of using the value #nKLAFk-1 of the preceding cycle, it is also possible to fix the value at 1.0.

When it is found in the step 20 that activation of the LAF sensor 40 has not been completed or it is found in the step S22 that the feedback control is not permissible, a cylinder-by-cylinder feedback gain #nKLAFk-idle calculated earlier while the engine was idling before shutdown is read from a backup area of the RAM 54 in a step S38 and the read value is used to correct the output fuel injection quantity by multiplication in a step S44. In other words, since a judgment in the step S20 that activation has not been completed means that the engine is in the course of starting (in a starting state following the cranking of the step S12), the variance in air-fuel ratio between cylinders can be suppressed by using a value calculated earlier during pre-shutdown idling to correct the output fuel injection quantity. The control in this case is open loop control and the fuel injection amount is not corrected by multiplication by the confluence point feedback gain KLAF. A value calculated during idling is used because the accuracy of the observer estimation is higher during low engine speed operation when the computation time is long. This is also applied to the case when the decision at the step S22 is negative.

When cranking is found to be in progress in the step S12, a step S46 calculates a fuel injection quantity Ticr during cranking from the coolant water temperature Tw in accordance with prescribed characteristics, whereafter the output fuel injection quantity Tout is decided on the basis of a start mode equation (explanation omitted) in a step S48. When step S14 finds that the fuel supply has been cut off, the output fuel injection quantity Tout is set to zero in a step S50.

The embodiment configured in the foregoing manner is able to absorb variance in air-fuel ratio between cylinders and converge the air-fuel ratios of the respective cylinders on the desired values with high accuracy. While violating a taboo of control design by connecting the feedback loops in series, the configuration prevents interference between the loops by autoregression of the gains. It is therefore possible to make maximum use of the results of the observer while simultaneously providing cylinder-by-cylinder air-fuel ratio feedback control enabling control on a par with confluence point air-fuel ratio feedback control even in the regions where observer estimation is impossible. If the desired air-fuel ratio is set at the stoichiometric air-fuel ratio as in the embodiment, therefore, the purification efficiency of the three-way catalytic converter 26 can be enhanced, while if it is set on the lean side, highly fuel efficient lean burn control can be realized with high accuracy.

When the system configured as described in the foregoing was verified by simulation, it was found that a fair amount of time was required for the air-fuel ratios of the cylinders to converge owing to the relatively small value in the vicinity of 1.0 set for the cylinder-by-cylinder feedback gain. However, since the variance in air-fuel ratio between cylinders is unlikely to change rapidly under normal circumstances, a somewhat slow convergence causes no particular problem.

Figure 22:
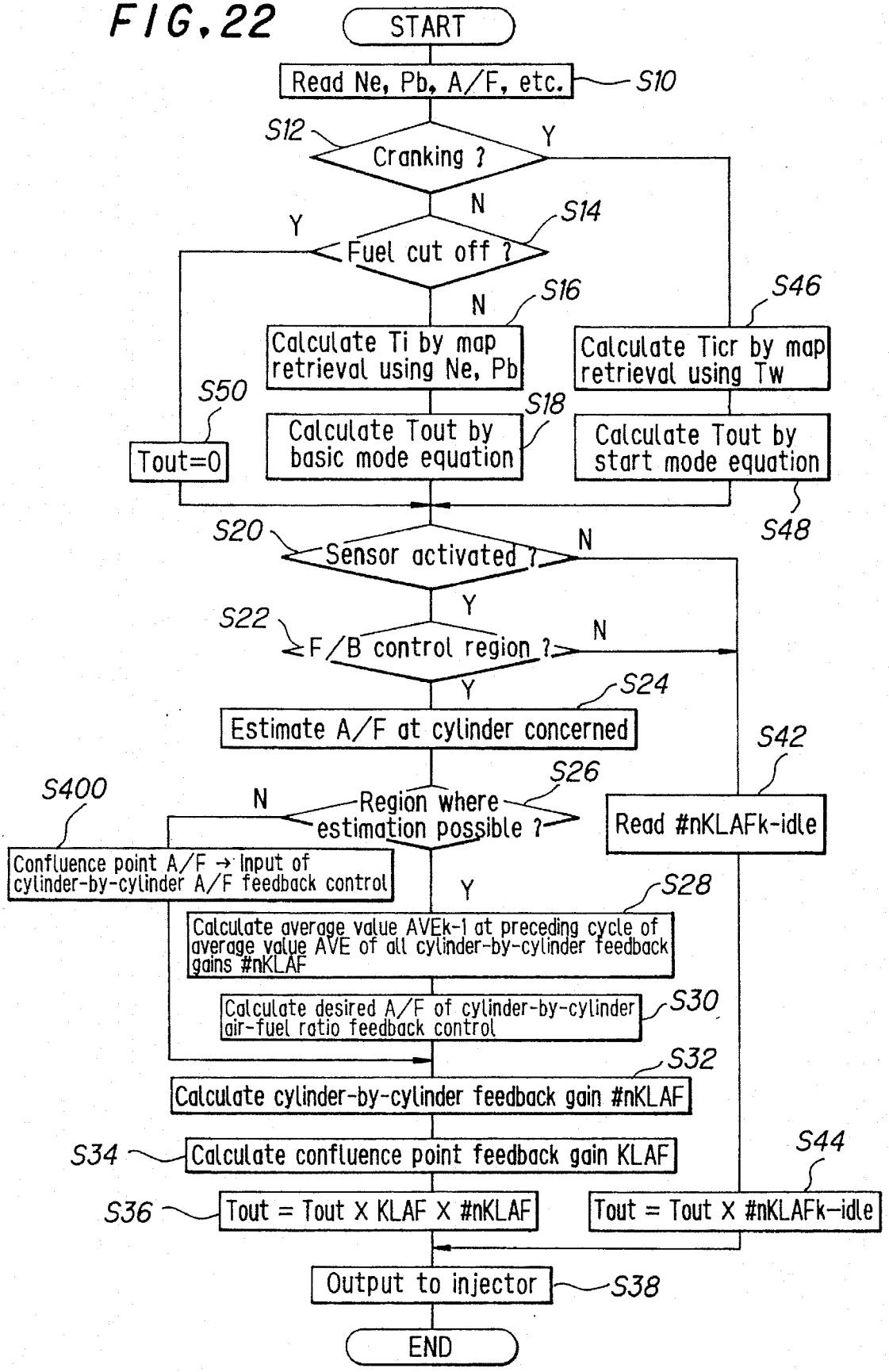
FIG. 22 is a flowchart, similar to FIG. 3, but showing the operation of an air-fuel ratio feedback control system according to a second embodiment of the present invention.

FIG. 22 is a flowchart similar to that of FIG. 3 showing a second embodiment of the invention. The difference between this and the first embodiment is that when the step S26 finds the operation to be in a region where observer estimation is impossible, the confluence point air-fuel ratio (detected value) is used as the input in the cylinder-by-cylinder air-fuel ratio control in a step S400 and the cylinder-by-cylinder feedback gain #nKLAF is calculated on the basis of this value in the step S32.

Figure 23:
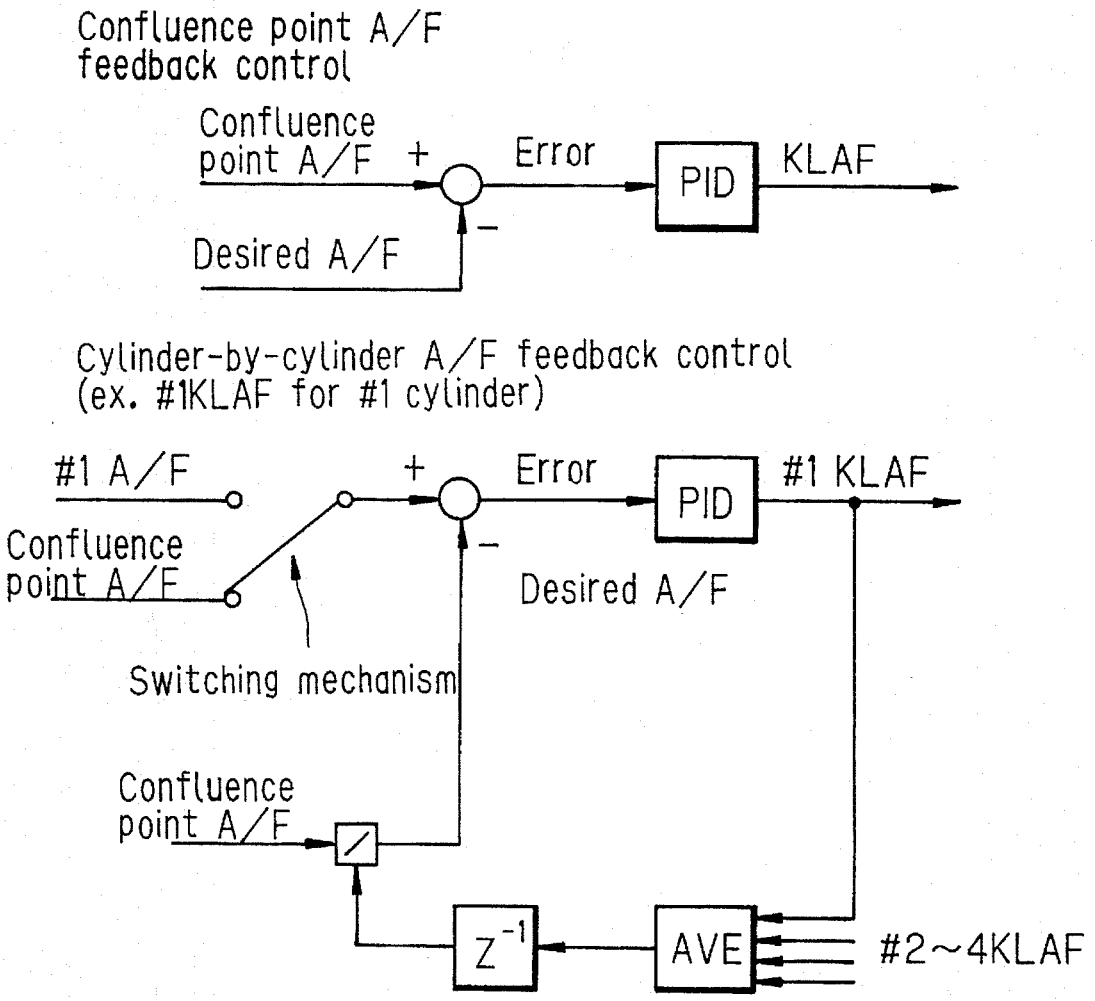
FIG. 23 is a block diagram, similar to FIG. 19 but showing the configuration of the air-fuel ratio feedback control system according the second embodiment of the present invention.

In other words, as shown in FIG. 23, a switching mechanism is provided for switching the input at regions where estimation is impossible. This arrangement has an advantage over the first embodiment. In the first embodiment the gain #nKLAFk-1 immediately before entry into such a region is used. Even so, however, the calculation is based on the uncertain estimated value and there is no guarantee that the value of the gain will be appropriate upon return to a region where estimation is possible. Since the detected air-fuel ratio at the confluence point used in the second embodiment has been converged toward the desired air-fuel ratio, the second embodiment can be expected to reduce the degree of inappropriateness in comparison with that where the calculated is based on the uncertain estimated value. The remainder of the configuration is the same as that of the first embodiment.

Although the first and second embodiments have been explained with respect to examples in which a model describing the behavior of the exhaust system is built and air-fuel ratio control is conducted using an observer which observes the internal state of the model, the air-fuel ratio feedback control system for an internal combustion engine according to this invention is not limited to this arrangement and can instead be configured to have the air-fuel ratio sensors (LAF sensors) disposed in the exhaust system in a number equal to the number of cylinders and so as to control the air-fuel ratios in the individual cylinders based on the measured air-fuel ratios in the individual cylinders.

Figure 24:
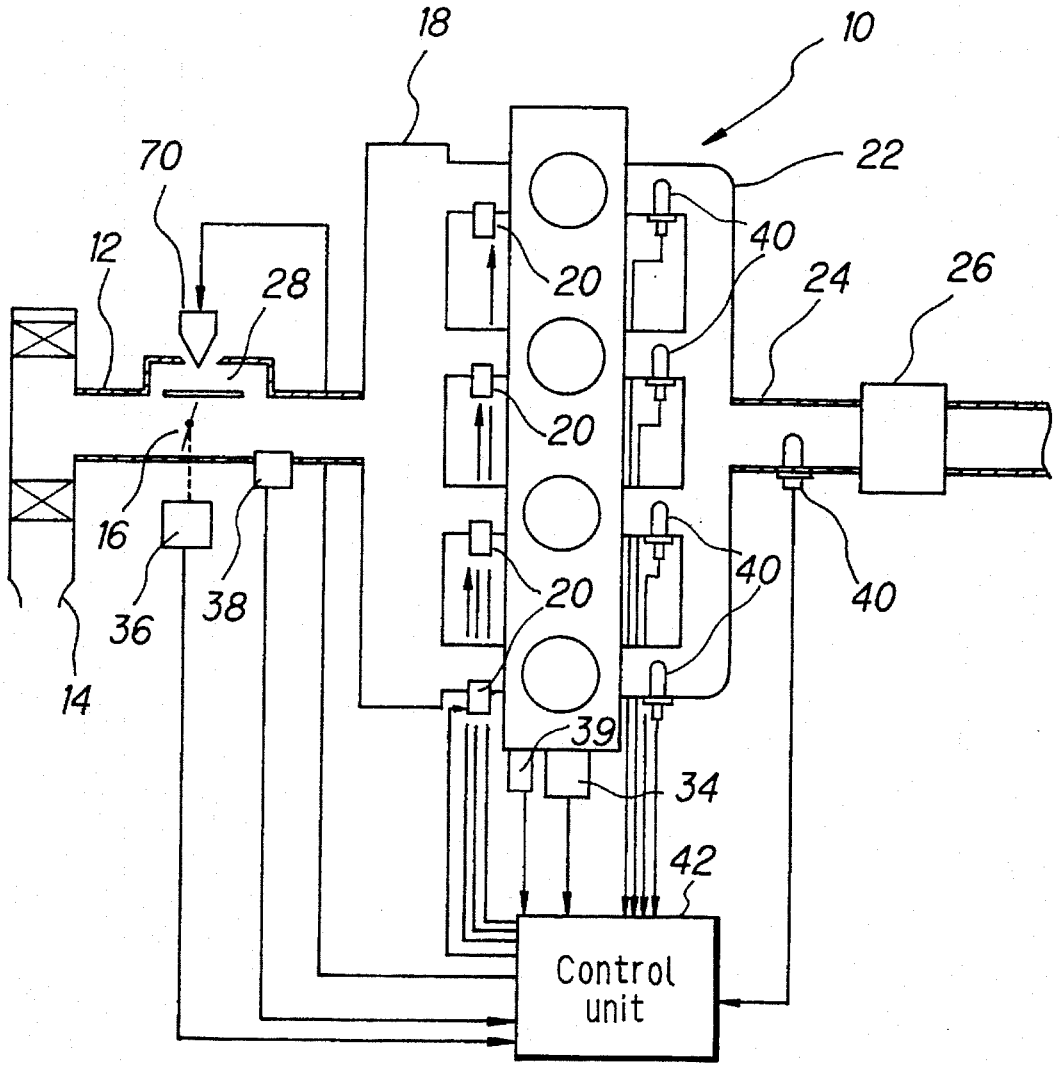
FIG. 24 is an overall schematic view of an air-fuel ratio feedback control system for internal combustion engine, similar to FIG. 1, but showing a third embodiment of the present invention.

FIG. 24 is a view of an air-fuel ratio feedback control system to that effect according to a third embodiment of the invention. As illustrated in the figure, four air-fuel ratio sensors 40 are additionally installed in the exhaust manifold 22 downstream of the exhaust valves of the individual cylinders. In the third embodiment, the air-fuel ratio at each cylinder is determined from the sensor output concerned in the step S24 in the flowcharts of FIG. 3. The rest of the third embodiment is the same as the first embodiment.

Moreover, while embodiments were explained with respect to the case of using a wide-range air-fuel ratio sensor (LAF sensor) as the air-fuel ratio sensor, it is alternatively possible to control the air-fuel ratio using an $O_2$ sensor.

The present invention has thus been shown and described with reference to specific embodiments. However, it should be noted that the present invention is in no way limited to the details of the described arrangements but changes and modifications may be made without departing from the scope of the appended claims.

What is claimed is:

1. A system for controlling an air-fuel ratio of an air-fuel mixture supplied to each cylinder of a multicylinder internal combustion engine, comprising:

an air-fuel ratio sensor installed at a location at or downstream of a confluence point of an exhaust system of said engine;

a circuit means for detecting a first air-fuel ratio at the confluence point of the exhaust system of the engine based on an output of the air-fuel ratio sensor:

individual cylinder air-fuel ratio estimating means for estimating a second air-fuel ratio at each cylinder of the engine based on the output of the air-fuel ratio sensor and a model describing a behavior of the exhaust system;

engine operating parameter detecting means for detecting parameters indicative of operating conditions of the engine at least including engine speed and engine load;

fuel injection quantity determining means for determining a fuel injection quantity at least based on the detected parameters of the engine;

first feedback control loop for determining a first feedback correction coefficient based on a first error between the first air-fuel ratio and a first desired air-fuel ratio to correct the fuel injection quantity by the first feedback correction coefficient;

a second feedback control loop for determining a second feedback correction coefficient based on a second error between a second air-fuel ratio and a second desired air-fuel ratio to correct the fuel injection quantity by the second feedback correction coefficient;

fuel injection quantity correcting means for correcting the determined fuel injection quantity by the first and second feedback correction coefficients; and a fuel injector for injecting fuel in a cylinder of said engine based on the corrected fuel injection quantity.

2. A system according to claim 1, wherein said second desired air-fuel ratio is determined by dividing said first air-fuel ratio by said second feedback correction coefficient.

3. A system according to claim 2, wherein said second feedback correction coefficient is determined cyclically and said second desired air-fuel ratio is determined by dividing said first air-fuel ratio by said second feedback correction coefficient for all cylinders determined at a previous cycle.

4. A system according to claim 1, wherein said individual cylinder air-fuel ratio estimating means including:

mathematical modeling means describing behavior of said exhaust system which inputs said output of said air-fuel ratio sensor; and an observer means for observing a state of said mathematical modeling means and for generating an output which estimates said second air-fuel ratio at said each cylinder.

5. A system according to claim 1, wherein said first feedback control loop and said second feedback control loop are connected in series such that said fuel injection quantity correcting means corrects the determined fuel injection quantity by multiplying by the first and second feedback correction coefficients.

6. A system according to claim 1, wherein said individual cylinder air-fuel ratio estimating means includes:

mathematical modeling means for describing behavior of said exhaust system which inputs said output of said air-fuel ratio sensor; and observer means for observing a state of said mathematical modeling means and for generating an output which estimates said second air-fuel ratio at said each cylinder.

7. A system according to claim 1, wherein said fuel injection quantity correction means corrects said determined fuel injection quantity by multiplying by said first and second feedback correction coefficient.

8. A system according to claim 1, wherein said second feedback correction coefficient is held to a prescribed value in a predetermined engine operation region defined with respect to engine speed and engine load.

9. A system according to claim 1, further including:

storing means for storing said second feedback correction coefficient determined when said engine is idling;

and said fuel injection quantity correction means corrects said determined fuel injection quantity by multiplying by said stored second feedback correction coefficient when the feedback control is inhibited.

10. A system for controlling an air-fuel ratio as recited in claim 1, wherein said circuit means, said individual cylinder air-fuel ratio estimating means, said engine operating parameter detecting means, said fuel injection quantity determining means, said first feedback control loop, said second feedback control loop, and said fuel injection quantity correcting means are configured in an engine control unit.

11. A system according to claim 8, wherein said second feedback control loop determines a third error between said first air-fuel ratio and said second air-fuel ratio in said predetermined engine operation region and determines said second feedback correction coefficient based on said third error.

12. A system according to claim 4, further including:

storing means for storing said second feedback correction coefficient determined when said engine is idling;

and said fuel injection quantity correction means corrects said determined fuel injection quantity by multiplying by said stored second feedback correction coefficient when the feedback control is inhibited.

13. A system according to claim 5, wherein said second desired air-fuel ratio is determined by dividing the first air-fuel ratio by said second feedback correction coefficient.

14. A system according to claim 13, wherein said second feedback correction coefficient is determined cyclically and said second desired air-fuel ratio is determined by dividing the first air-fuel ratio by an average of said second feedback correction coefficient for all cylinders determined at a previous cycle.

15. A system according to claim 6, wherein said second feedback correction coefficient is held to a prescribed value in a predetermined engine operation region defined with respect to engine speed and engine load.

16. A system according to claim 15, wherein said second feedback control loop determines a third error between said first air-fuel ratio and said second air-fuel ratio in said predetermined engine operation region and determines said second feedback correction coefficient based on said third error.

17. A system according to claim 6, wherein said second desired air-fuel ratio is determined by dividing said first air-fuel ratio by said second feedback correction coefficient.

18. A system according to claim 17, wherein said second feedback correction coefficient is determined cyclically and said second desired air-fuel ratio is determined by dividing said first air-fuel ratio by an average of said second feedback correction coefficient for all cylinders determined at a previous cycle.

19. A system according to claim 6, further including:

storing means for storing said second feedback correction coefficient determined when said engine is idling;

and said fuel injection quantity correction means corrects said determined fuel injection quantity by multiplying by said stored second feedback correction coefficient when the feedback control is inhibited.

20. A system for controlling an air-fuel ratio of an air-fuel mixture supplied to each cylinder of a multi-cylinder internal combustion engine, said system comprising:

an air-fuel ratio sensor installed at a location at or downstream of a confluence point of an exhaust system of said engine;

a fuel injector for injecting fuel in a cylinder of said engine;

a microprocessor for controlling said fuel injector, said microprocessor being configured to:

detect a first air-fuel ratio at the confluence point of the exhaust system of the engine based upon an output of the air-fuel ratio sensor;

estimate a second air-fuel ratio at each cylinder of the engine based on an output of the air-fuel ratio sensor and a model describing a behavior of the exhaust system;

detect parameters indicative of operating conditions of the engine at least including engine speed and engine load;

determine a fuel injection quantity based on the detected parameters of the engine;

implement a first feedback control loop for determining a first feedback correction coefficient based on a first error between the first air-fuel ratio and a first desired air-fuel ratio to correct the fuel injection quantity by the first feedback correction coefficient;

implement a second feedback control loop for determining a second feedback correction coefficient based on a second error between a second air-fuel ratio and a second desired air-fuel ratio to correct the fuel injection quantity by the second feedback correction coefficient;

correct the determined fuel injection quantity by the first and second feedback correction coefficients; and control said fuel injector to inject fuel in a cylinder of the engine based on the corrected fuel injection quantity.

21. A system according to claim 20, wherein said microprocessor is further configured to determine the second desired air-fuel ratio by dividing the first air-fuel ratio by the second feedback correction coefficient.

22. A system according to claim 21, wherein said microprocessor is configured to determine said second feedback correction coefficient cyclically, and to determine the second desired air-fuel ratio by dividing the first air-fuel ratio by the second feedback correction coefficient for all cylinders determined at a previous cycle.

23. A system according to claim 20, wherein said microprocessor is further configured to correct said determined fuel injection quantity by multiplying the fuel injection quantity by the first and second feedback correction coefficients.

24. A system according to claim 20, wherein said microprocessor is configured to hold said second feedback correction coefficient to a prescribed value in a predetermined engine operation region, said predetermined engine operation region being defined with respect to engine speed and engine load.

25. A system according to claim 24, wherein said microprocessor is configured to determine a third error between said first air-fuel ratio and said second air-fuel ratio in said predetermined engine operation region, and to determine said second feedback correction coefficient based upon said third error.

26. A system according to claim 20, wherein said microprocessor is configured to store said second feedback correction coefficient determined when said engine is idling, and to correct said determined fuel injection quantity by multiplying said determined fuel injection quantity by said stored second feedback correction coefficient when feedback control is inhibited.

27. The system according to claim 20, wherein said microprocessor is configured to determine the second desired air-fuel ratio by dividing the first air-fuel ratio by the second feedback correction coefficient.

28. The system according to claim 27, wherein the microprocessor is further configured to determine the second feedback correction coefficient cyclically, and determine the second desired air-fuel ratio by dividing the first air-fuel ratio by an average of the second feedback correction coefficient for all cylinders determined at a previous cycle.

29. A system according to claim 27, wherein said microprocessor is configured to store said second feedback correction coefficient determined when said engine is idling, and to correct said determined fuel injection quantity by multiplying said determined fuel injection quantity by said stored second feedback correction coefficient when feedback control is inhibited.

30. The system according to claim 20, wherein said microprocessor is further configured to:

mathematically model behavior of said exhaust system, and to input said output of said air-fuel ratio sensor; and observe said mathematical model and to generate an output which estimates said second air-fuel ratio at said each cylinder.

31. A system according to claim 30, wherein said microprocessor is configured to store said second feedback correction coefficient determined when said engine is idling, and to correct said determined fuel injection quantity by multiplying said determined fuel injection quantity by said stored second feedback correction coefficient when feedback control is inhibited.

32. A system according to claim 30, wherein said microprocessor is configured to determine said second desired air-fuel ratio by dividing said first air-fuel ratio by said second feedback correction coefficient.

33. A system according to claim 32, wherein said microprocessor is further configured to determine said second feedback correction coefficient cyclically, and to determine said second desired air-fuel ratio by dividing said first air-fuel ratio by an average of said second feedback correction coefficient for all cylinders determined at a previous cycle.

34. A system according to claim 30, wherein said microprocessor is configured to hold said second feedback correction coefficient to a prescribed value in a predetermined engine operation region, said predetermined engine operation region being defined with respect to engine speed and engine load.

35. A system according to claim 34, wherein said microprocessor is configured to determine a third error between said first air-fuel ratio and said second air-fuel ratio in said predetermined engine operation region, and to determine said second feedback correction coefficient based upon said third error.

36. A system for controlling an air-fuel ratio of an air-fuel mixture supplied to each cylinder of a multicylinder internal combustion engine, comprising:

individual cylinder air-fuel ratio sensors, each of said individual cylinder air-fuel ratio sensors being installed at or downstream of an exhaust port of each cylinder of the engine;

confluence point air-fuel ratio detecting means for detecting confluence point air-fuel ratio based upon at least one of outputs of the individual cylinder air-fuel ratio sensors;

individual cylinder air-fuel ratio detecting means coupled to said individual cylinder air-fuel ratio sensors for detecting individual air-fuel ratios at each cylinder of the engine based on each output of the individual cylinder air-fuel ratio sensors;

engine operating parameter detecting means for detecting parameters indicative of operating conditions of the engine at least including engine speed and engine lead;

fuel injection quantity determining means for determining a fuel injection quantity at least based on the detected parameters of the engine;

a first feedback control loop for determining a first feedback correction coefficient based on a first error between the confluence point air-fuel ratio and a first desired air-fuel ratio to correct the fuel injection quantity by the first feedback correction coefficient;

a second feedback control loop for determining a second feedback correction coefficient based on a second error between the individual air-fuel ratio and a second desired air-fuel ratio to correct the fuel injection quantity by the second feedback correction coefficient;

fuel injection quantity correcting means for correcting the determined fuel injection quantity by the first and second feedback correction coefficients; and fuel injector for injecting fuel in a cylinder of said engine based on the corrected fuel injection quantity.

37. A system according to claim 36, wherein said second desired air-fuel ratio is determined by dividing said first air-fuel ratio by said second feedback correction coefficient.

38. A system according to claim 37, wherein said second feedback correction coefficient is determined cyclically and said second desired air-fuel ratio is determined by dividing said first air-fuel ratio by an average of said second feedback correction coefficient for all cylinders determined at a previous cycle.

39. A system according to claim 36, wherein said fuel injection quantity correction means corrects said determined fuel injection quantity by multiplying by said first and second feedback correction coefficient.

40. A system for controlling an air-fuel ratio as recited in claim 36, wherein said circuit means, said individual cylinder air-fuel ratio estimating means, said engine operating parameter detecting means, said fuel injection quantity determining means, said first feedback control loop, said second feedback control loop, and said fuel injection quantity correcting means are configured in an engine control unit.

41. A system according to claim 36, wherein said second feedback correction coefficient is held to a prescribed value in a predetermined engine operation region defined with respect to engine speed and engine load.

42. A system according to claim 41, wherein said second feedback control loop determines a third error between said first air-fuel ratio and said second air-fuel ratio in said predetermined engine operation region and determines said second feedback correction coefficient based on said third error.

43. A system according to claim 36, further including:

storing means for storing said second feedback correction coefficient determined when said engine is idling;

and said fuel injection quantity correction means corrects said determined fuel injection quantity by multiplying by said stored second feedback correction coefficient when the feedback control is inhibited.

44. A system for controlling an air-fuel ratio of an air-fuel mixture supplied to each cylinder of a multi-cylinder internal combustion engine, said system comprising:

individual cylinder air-fuel ratio sensors, each of said individual cylinder air-fuel ratio sensors installed at or downstream of an exhaust port of each cylinder of the engine;

a fuel injector for injecting fuel in a cylinder of the engine;

a microprocessor for controlling the fuel injector, said microprocessor being configured to:

detect a confluence point air-fuel ratio based upon at least one output of outputs of the individual cylinder air-fuel ratio sensors;

detect individual air-fuel ratios at each cylinder of the engine based upon each output of the individual cylinder air-fuel ratio sensors;

detect parameters indicative of operating conditions of the engine speed and engine load;

determine a fuel injection quantity at least based on the detected parameters of the engine;

implement a first feedback control loop for determining a first feedback correction coefficient based on a first error between the confluence point air-fuel ratio and a first desired air-fuel ratio to correct the fuel injection quantity by the first feedback correction coefficient;

implement a second feedback control loop for determining a second feedback correction coefficient based on the second error between the individual air-fuel ratio and a second desired air-fuel ratio to correct the fuel injection quantity by the second feedback correction coefficient;

correct the determined fuel injection quantity by the first and second feedback correction coefficients; and control said fuel injector to inject fuel in a cylinder of said engine based on the corrected fuel injection quantity.

45. A system according to claim 44, wherein the microprocessor is further configured to determine the second desired air-fuel ratio by dividing the first air-fuel ratio by the second feedback correction coefficient.

46. A system according to claim 45, wherein the microprocessor is further configured to determine the second correction coefficient cyclically and to determine the second desired air-fuel ratio by dividing the first air-fuel ratio by an average of the second feedback correction coefficient for all cylinders determined at a previous cycle.

47. A system according to claim 44, wherein said microprocessor is further configured to correct said determined fuel injection quantity by multiplying the fuel injection quantity by the first and second feedback correction coefficients.

48. A system according to claim 44, wherein said microprocessor is configured to hold said second feedback correction coefficient to a prescribed value in a predetermined engine operation region, said predetermined engine operation region being defined with respect to engine speed and engine load.

49. A system according to claim 48, wherein said microprocessor is configured to determine a third error between said first air-fuel ratio and said second air-fuel ratio in said predetermined engine operation region, and to determine said second feedback correction coefficient based upon said third error.

50. A system according to claim 44, wherein said microprocessor is configured to store said second feedback correction coefficient determined when said engine is idling, and to correct said determined fuel injection quantity by multiplying said determined fuel injection quantity by said stored second feedback correction coefficient when feedback control is inhibited.

51. A system for controlling an air-fuel ratio of an air-fuel mixture supplied to each cylinder of a multicylinder internal combustion engine, comprising:

individual cylinder air-fuel ratio sensors, each of said individual cylinder air-fuel ratio sensors being installed at or downstream of an exhaust port of each cylinder of the engine;

a confluence point air-fuel ratio sensor installed at or downstream of a confluence point of an exhaust system of the engine;

confluence point air-fuel ratio detecting means for detecting confluence point air-fuel ratio based upon an output of the confluence point air-fuel ratio sensor;

individual cylinder air-fuel ratio detecting means coupled to said individual cylinder air-fuel ratio sensors for detecting individual air-fuel ratios at each cylinder of the engine based on each output of the individual cylinder air-fuel ratio sensors;

engine operating parameter detecting means for detecting parameters indicative of operating conditions of the engine at least including engine speed and engine load;

fuel injection quantity determining means for determining a fuel injection quantity at least based on the detected parameters of the engine;

a first feedback control loop for determining a first feedback correction coefficient based on a first error between the confluence point air-fuel ratio and a first desired air-fuel ratio to correct the fuel injection quantity by the first feedback correction coefficient;

a second feedback control loop for determining a second feedback correction coefficient based on a second error between the individual air-fuel ratio and a second desired air-fuel ratio to correct the fuel injection quantity by the second feedback correction coefficient;

fuel injection quantity correcting means for correcting the determined fuel injection quantity by the first and second feedback correction coefficients; and a fuel injector for injecting fuel in a cylinder of said engine based on the corrected fuel injection quantity.

52. A system for controlling an air-fuel ratio of an air-fuel mixture supplied to each cylinder of a multi-cylinder internal combustion engine, said system comprising:

individual cylinder air-fuel ratio sensors, each of said individual cylinder air-fuel ratio sensors installed at or downstream of an exhaust port of each cylinder of the engine;

a confluence point air-fuel ratio sensor installed at or downstream of a confluence point of an exhaust system of the engine;

a fuel injector for injecting fuel in a cylinder of the engine;

a microprocessor for controlling the fuel injector, said microprocessor being configured to:

detect a confluence point air-fuel ratio based upon an output of the confluence point air-fuel ratio sensor;

detect individual air-fuel ratios at each cylinder of the engine based upon each output of the individual cylinder air-fuel ratio sensors;

detect parameters indicative of operating conditions of the engine speed and engine load;

determine a fuel injection quantity at least based on the detected parameters of the engine;

implement a first feedback control loop for determining a first feedback correction coefficient based on a first error between the confluence point air-fuel ratio and a first desired air-fuel ratio to correct the fuel injection quantity by the first feedback correction coefficient;

implement a second feedback control loop for determining a second feedback correction coefficient based on the second error between the individual air-fuel ratio and a second desired air-fuel ratio to correct the fuel injection quantity by the second feedback correction coefficient;

correct the determined fuel injection quantity by the first and second feedback correction coefficients; and control said fuel injector to inject fuel in a cylinder of said engine based on the corrected fuel injection quantity.

* * * * *